US008991807B2

(12) United States Patent
Konishi et al.

(10) Patent No.: US 8,991,807 B2
(45) Date of Patent: Mar. 31, 2015

(54) RELAY APPARATUS AND IMAGE FORMING SYSTEM

(71) Applicant: Konica Minolta, Inc., Chiyoda-ku, Tokyo (JP)

(72) Inventors: Hiroyuki Konishi, Hachioji (JP); Kenichi Yamada, Higashiyamato (JP); Satoru Shirasaka, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/954,911

(22) Filed: Jul. 30, 2013

(65) Prior Publication Data

US 2014/0042686 A1 Feb. 13, 2014

(30) Foreign Application Priority Data

Aug. 7, 2012 (JP) ..... 2012-175421

(51) Int. Cl.

| | |
|---|---|
| ***B65H 33/04*** | (2006.01) |
| ***G03G 15/00*** | (2006.01) |
| ***B65H 29/12*** | (2006.01) |
| ***B65H 43/00*** | (2006.01) |
| ***G03G 21/16*** | (2006.01) |

(52) U.S. Cl.

CPC ..... *G03G 15/6538* (2013.01); *B65H 29/125* (2013.01); *B65H 43/00* (2013.01); *B65H 2301/44522* (2013.01); *B65H 2402/62* (2013.01); *B65H 2511/415* (2013.01); *B65H 2511/51* (2013.01); *B65H 2511/515* (2013.01); *B65H 2513/50* (2013.01); *B65H 2513/512* (2013.01); *B65H 2557/12* (2013.01);

(Continued)

(58) Field of Classification Search

USPC ..... 270/1.01, 52.02, 58.07; 399/408

See application file for complete search history.

(56) References Cited

U.S. PATENT DOCUMENTS 4,674,866 A * 6/1987 Tanaka ..... 355/23
7,107,004 B2 * 9/2006 Saito ..... 399/405

(Continued)

FOREIGN PATENT DOCUMENTS

JP 2003-155160 A 5/2003
JP 2006-350961 A 12/2006

(Continued)

OTHER PUBLICATIONS

Japanese Office Action dated Oct. 22, 2014, issued in counterpart Japanese Application No. 2012-175421.

*Primary Examiner* — Leslie A Nicholson, III

(74) *Attorney, Agent, or Firm* — Holtz, Holtz, Goodman & Chick PC

(57) ABSTRACT

Disclosed is an image forming system including: an image forming device to notify a downstream post-processing device of sheet information relating to a sheet on which an image is formed, before the sheet is discharged, and to notify the downstream post-processing device of set separation information indicating a final sheet of each set of document in synchronization with the sheet information relating to the final sheet of each set in case that a plurality of sets of document are printed, the image forming device being compliant with a first communication system; a post-processing device which is connected to a downstream of the image forming device and is compliant with a second communication system which is different from the first communication system; and the relay apparatus which is connected to the image forming device through the first communication system and is connected to the post-processing device through the second communication system.

8 Claims, 22 Drawing Sheets

(52) U.S. Cl.
CPC ..... *B65H2557/25* (2013.01); *B65H 2801/27* (2013.01); *G03G 21/1652* (2013.01)
USPC ..... 270/52.02; 270/58.07

(56) References Cited

U.S. PATENT DOCUMENTS

| | | | | |
|---|---|---|---|---|
| 7,571,909 | B2 * | 8/2009 | Saeki et al. | 271/292 |
| 7,773,904 | B2 * | 8/2010 | Ushio | 399/82 |
| 2006/0285151 | A1 | 12/2006 | Kurita | |
| 2008/0152409 | A1 * | 6/2008 | Funada | 399/405 |

FOREIGN PATENT DOCUMENTS

| | | | |
|---|---|---|---|
| JP | 2007-079539 | A | 3/2007 |
| JP | 2007-106594 | A | 4/2007 |
| JP | 2008-191593 | A | 8/2008 |
| JP | 2008303061 | A | 12/2008 |
| JP | 2009251186 | A | 10/2009 |
| JP | 2010064408 | A | 3/2010 |

* cited by examiner

RELAY APPARATUS AND IMAGE FORMING SYSTEM

BACKGROUND OF THE INVENTION

1. Field of the Invention

The present invention relates to a relay apparatus which relays a signal between an image forming device and a post-processing device which have different interfaces, and an image forming system including the relay apparatus.

2. Description of Related Art

To a subsequent stage of an image forming device which prints out an image by forming the image on a sheet, one or a plurality of post-processing devices having each function to perform processing such as punching, stitching, and folding, and to bundle a plurality of sheets to create a brochure are connected in series. Thereby, an image forming system is configured.

In such an image forming system, various types of information are exchanged between the image forming device and the post-processing device in order to match various sheet conditions (sheet size, paper type, and basis weight) or post-processing conditions. For example, the information is exchanged in the following sequences.

At the timing of feeding a sheet from a sheet feeding unit of the image forming device, the image forming device notifies the post-processing device of the sheet feed information including the sheet information relating to the above sheet and the post-processing information indicating the contents of post-processing to be performed for the above sheet. Based on the notified sheet feed information, each post-processing device calculates time necessary for the post-processing in the post-processing device and time corresponding to a sheet interval, and notifies the image forming device of the above calculated time. The image forming device allows the fed sheet to stand by at a predetermined standby position provided on the way to a carrier path, and releases a standby state to discharge the sheet at the timing corresponding to the time notified by the post-processing device. By this control, a sheet interval necessary for the post-processing device is secured.

For the purpose of performing post-processing for creating brochures, the set separation information indicating the separation between two sets of document is further needed in addition to the above-described sheet feed information. It is required to notify the set separation information of the post-processing device between the sets of document (an interval from a final sheet of the set to a first sheet of the next set). Therefore, in the above-described sequence, the set separation information is notified to the post-processing device in synchronization with the sheet feed information of the final sheet.

FIG. 20 shows a connection example in the case where an image forming device and a plurality of post-processing devices are connected in series through serial interfaces (I/F) of the same communication system (protocol). In such a connection state, the information is sent in order from upstream to downstream (image forming device→post-processing device 1→post-processing device 2→post-processing device 3) or from downstream to upstream, and the information is transmitted.

FIG. 21 shows a specific example in the case where sheet feed information is notified through the above-described sequence in an image forming system shown in FIG. 20. In this example, there is shown a communication sequence in which a punch process is performed in the post-processing device 1, a sheet is carried by a bypass conveyance in the post-processing device 2 (a sheet is carried to a subsequent-stage post-processing device without performing post-processing), and a side stitching process is performed in the post-processing device 3 to create two sets of brochures each of which has two sheets.

Every when one sheet is fed, the image forming device outputs sheet feed information (sheet information and post-processing information) relating to a sheet to be fed and carried to the subsequent-stage post-processing devices. The sheet feed information is transmitted in order from the image forming device to the post-processing device 1→the post-processing device 2→the post-processing device 3. In FIG. 21, a suffix added to each piece of information indicates that the sheet number of the sheet corresponding to the information and the set number of the set including the above sheet. To be more specific, "1-1", "1-2", "2-1", and "2-2" indicate a first sheet of a first set, a second sheet of the first set, a first sheet of a second set, and a second sheet of the second set, respectively.

Based on the received sheet feed information, each post-processing device calculates time of a sheet interval necessary for post-processing (time for allowing a sheet to stand by in the image forming device). Then, each post-processing device notifies wait information indicating the calculated time in the order of the post-processing device 3→the post-processing device 2→the post-processing device 1→the image forming device to notify the image forming device of the wait information. The wait information is sent back for each piece of sheet feed information (for each sheet). For example, the wait information 2-1 indicates a sheet interval between the second sheet of the first set and the first sheet of the second set.

By stopping a sheet temporarily at a standby position in accordance with the time indicated by the wait information notified from the post-processing device, the image forming device secures the time (sheet interval) necessary for the post-processing device. For example, the standby time at the standby position in the image forming device (timing for releasing the standby state) is controlled so as to set the time until the first sheet of the second set is discharged (output timing of the sheet discharge information 2-1) after the second sheet of the first set is discharged (output timing of the sheet discharge information 1-2), to the time indicated by the wait information 2-1.

Further, in synchronization with the sheet feed information, the set separation information is transmitted in order, specifically, from the image forming device to the post-processing device 1→the post-processing device 2→the post-processing device 3 after the sheet feed information relating to the final sheet of each set. That is, the set separation information is notified significantly before the final sheet of the set is actually discharged to the post-processing device. In addition, the sheet discharge information is notified to a subsequent-stage device in accordance with the timing at which a sheet is discharged from each device.

In recent years, a post-processing device in the image forming system has been diversified into various kinds. The demand that not only a post-processing device of a manufacturer which manufactures an image forming device but also a post-processing device of a different manufacturer (hereinafter, referred to as a third vendor) is connected and operated on line, has been increased.

On the other hand, with regard to the connection of the post-processing device in the image forming system, each communication specification for exchanging information is not standardized and unified.

In this background, it is inefficient that each third vendor is compliant with complicated interface specifications of a manufacturer which manufactures the image forming device. To solve the above problem, a parallel interface is adopted as a simple interface which is common to each third vendor. It is not necessary for a third vendor to be conscious of the interface specification of a manufacturer of the image forming device main body and the interface specification of each manufacturer, and a post-processing device can be developed and provided by using only a simple interface. Note that in the case of parallel communication, the set separation information needs to be notified in synchronization with the sheet discharge information.

Further, as shown in FIG. 22, the following image forming device is proposed (see Japanese Patent Application Publication No. 2006-350961). In the image forming device, both a serial interface and a parallel interface are provided, and a post-processing device (genuine device) which is compliant with the serial interface and a post-processing device (third vendor device) which is compliant with the parallel interface can be connected.

In addition, the technique for notifying a subsequent-stage post-processing device of the sheet information at the timing at which each post-processing device discharges a sheet therefrom or at the timing at which a sheet is carried to a predetermined position, is disclosed (see Japanese Patent Application Publication Nos. 2007-079539 and 2007-106594). The technique for connecting an inserter device via a post-processing device, is disclosed (see Japanese Patent Application Publication No. 2008-191593). The technique for providing an interface device which connects a plurality of post-processing devices to an image forming device and managing a plurality of post-processing devices, for example, by determining the post-processing device to be used, in accordance with the contents of post-processing, is disclosed (see Japanese Patent Application Publication No. 2003-155160).

In the parallel interface, the amount of information to be exchanged is very small as compared to the serial interface. Therefore, for example, it is necessary to limit the function of controlling the device (third vendor device) connected through the parallel interface as compared to a conventional system. Further, the necessary information is stored in another unit, for example, the storage unit of the image forming device.

In case that a post-processing device (genuine device) which is compliant with a serial interface a manufacturer of an image forming device and a post-processing device (third vendor device) which is compliant with a parallel interface are mixed to configure an image forming system, because a number of combinations of types of devices to be connected and the number of the devices to be connected are considered, it is difficult for the image forming device to have interfaces for all post-processing devices and to handle all connection patterns.

In the set separation information, the image forming device which is a genuine device and which performs the above-described communication sequence of FIG. 21, outputs the set separation information in synchronization with the sheet feed information. The third-vendor post-processing device which performs communication through the parallel interface is required to receive the set separation information in synchronization with the sheet discharge information. Accordingly, some sort of control is required in order to connect the post-processing device which is a third vendor device and which performs communication through the parallel interface, to the image forming device which is the genuine device and which performs the communication sequence of FIG. 21.

For example, in case that the post-processing device which is the genuine device and the post-processing device which is the third vendor device compliant with the parallel interface, are mixedly connected to the image forming device, when the image forming device controls the transmission timing of the set separation information, the image forming device allows any of the post-processing device which is the third vendor device and the post-processing device which is the genuine device to perform the post-processing for creating a brochure. In addition, based on various post-processing conditions, it is required to change the control for transmitting the set separation information. Therefore, it is required to add the function for changing the above control to the image forming device main body. Further, when the number of types of the third vendor device to be connected is increased, it is very troublesome that the necessary functions are added to the image forming device so as to handle all the third vendor devices.

Further, because the heights at which the carrier inlet and the carrier outlet for the sheets are disposed from the installation surface are also different from each other depending on the third vendor devices, it is required to adjust the above heights in order to connect the third vendor device to the image forming system and carry the sheet.

The techniques disclosed in the above Japanese Patent Application Publications, do not solve the problem which is caused when the set separation information output from the image forming device is notified to a post-processing device having a different communication system.

SUMMARY

To achieve at least one of the abovementioned objects, a relay apparatus reflecting one aspect of the present invention, comprises:

a receiving unit to receive set separation information indicating a final sheet of each set of document to be printed, from an image forming device which is compliant with a first communication system, the image forming device notifying a downstream post-processing device of sheet information relating to a sheet on which an image is formed, before the sheet is discharged, and the image forming device notifying the downstream post-processing device of the set separation information in synchronization with the sheet information relating to the final sheet of the each set of document in case that a plurality of sets of document are printed;

a storage unit to store the set separation information received by the receiving unit; and a notification unit to notify a post-processing device of the set separation information stored in the storage unit, in synchronization with a timing at which the final sheet of the each set indicated by the set separation information is discharged to the post-processing device, the post-processing device being connected to a downstream of the image forming device and being compliant with a second communication system which is different from the first communication system.

Preferably, a communication with the image forming device is performed by a serial communication, and a communication with the post-processing device is performed by a parallel communication.

Preferably, the relay apparatus further comprises a sheet carrier unit to receive the sheet from a carrier outlet of an upstream device of the relay apparatus, and to carry and discharge the sheet to a carrier inlet of a downstream device of the relay apparatus, the carrier inlet being disposed at a height from an installation surface of the relay apparatus, which is different from a height at which the carrier outlet of the upstream device is disposed from the installation surface.

Preferably, after a back-end of the final sheet of the each set is discharged to the post-processing device, the notification unit notifies the post-processing device of the set separation information.

Preferably, the image forming device receives sheet interval information indicating a sheet interval necessary for the post-processing device from the post-processing device as a response of the sheet information transmitted every when the sheet is fed, and discharges the sheet at a timing based on the sheet interval information.

Preferably, in case that a second post-processing device which is compliant with the first communication system is further connected to the downstream of the image forming device, when only the second post-processing device performs a post-processing for the sheet, the notification unit does not notify the post-processing device of the set separation information and the notification unit notifies the second post-processing device of the set separation information in synchronization with the sheet information relating to the final sheet of the each set, and when only the post-processing device performs a post-processing for the sheet, the notification unit does not notify the second post-processing device of the set separation information and the notification unit notifies the post-processing device of the set separation information in synchronization with the timing at which the final sheet of the each set is discharged to the post-processing device.

BRIEF DESCRIPTION OF THE DRAWINGS

The present invention will become more fully understood from the detailed description given hereinafter and the accompanying drawings given by way of illustration only, and thus are not intended as a definition of the limits of the present invention, and wherein:

" (FIG. 8: Step S103);

" (FIG. 8: Step S104);

" (FIG. 8: Step S104) performed by the relay apparatus according to the third embodiment;

DETAILED DESCRIPTION OF PREFERRED EMBODIMENTS

Hereinafter, preferred embodiments of the present invention will be explained with reference to the accompanying drawings.

First Embodiment

Figure 1:
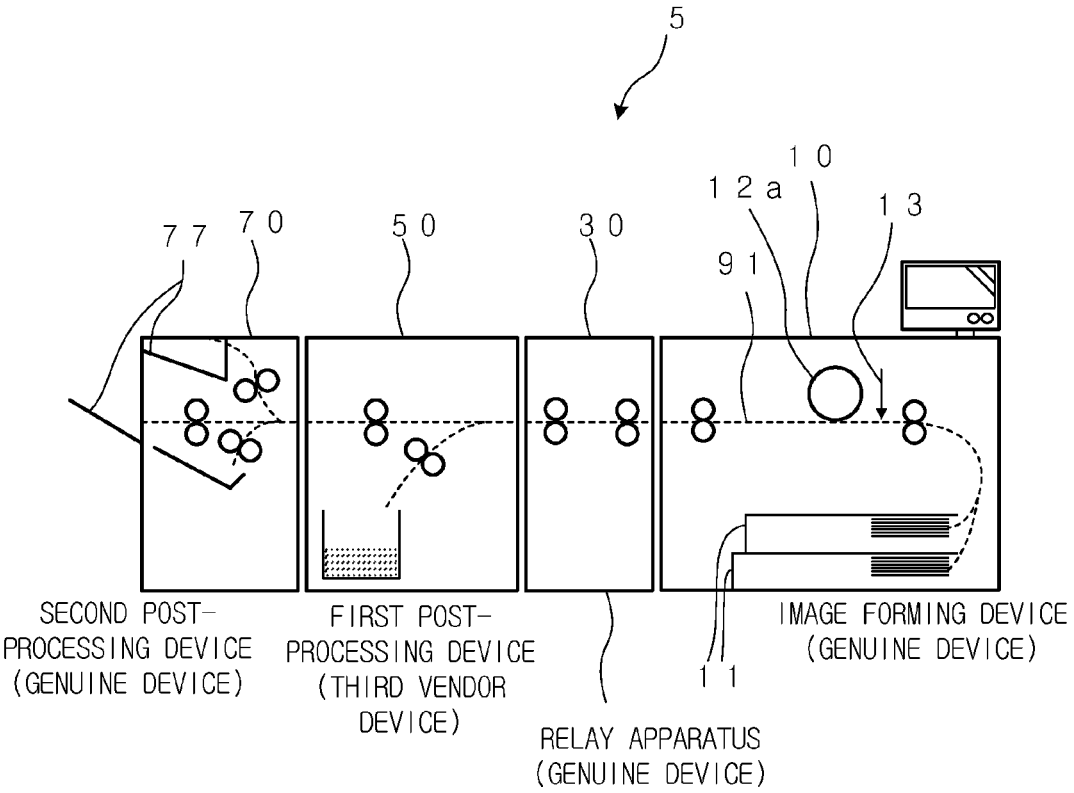
FIG. 1 shows a system configuration example of the image forming system according to the first embodiment.

FIG. 1 shows a system configuration example of an image forming system 5 according to the first embodiment. The image forming system 5 is configured by connecting a relay apparatus 30, a first post-processing device 50 which is a post-processing device of a third vendor, and a second post-processing device 70 manufactured by the same manufacturer as the image forming device 10 to a subsequent stage (downstream) of an image forming device 10 in this order so as to connect the carrier path 91 (indicated by a broken line in FIG. 1) in series. The image forming device 10, the relay apparatus 30, and the second post-processing device 70 are genuine devices manufactured by A manufacturer, and the first post-processing device 50 is a third vendor device manufactured by Z manufacturer. In the image forming system 5, all carrier outlets and carrier inlets for the sheets are disposed at the same height from the installation surface of each device (hereinafter, referred to as a ground height).

The image forming device 10 has a function to feed a sheet stored in a sheet feeding unit 11 to carry it, form (print) an image on it, and then discharge it to a subsequent stage from the carrier outlet. Further, the image forming device 10 can temporarily stop the carry of the sheets fed from the sheet feeding unit 11 at a predetermined standby position (register position) 13 provided on the upstream side of a photoconductive drum 12*a* of an image forming unit 12 which is hereinafter described, in order to allow the sheet to stand by.

The relay apparatus 30 has a function to receive the sheet discharged from the carrier outlet of the image forming device 10 and directly carry it to the first subsequent-stage post-processing device 50 to discharge it. In addition, the relay apparatus 30 has a function to relay communication between the image forming device 10 and any one of the first and second post-processing devices 50 and 70.

The first post-processing device 50 has a function to perform the predetermined post-processing to the sheet carried from a previous-stage device (one step upstream side). Here, the first post-processing device 50 has a function to perform the post-processing for creating brochures such as cutting and bookbinding and to store a number of cut and bound sheets. In addition, the first post-processing device 50 has a function of a bypass conveyance to carry sheets to the subsequent stage to discharge them without performing the post-processing.

The second post-processing device 70 is a genuine device of the same manufacturer as the image forming device 10, and has a function to perform the predetermined post-processing to the sheet carried from a previous-stage device. Here, the second post-processing device 70 has a function to perform the side stitching for the sheets and create a brochure. In addition, the second post-processing device 70 has a sheet stacking unit 77 which stacks sheets to be discharged.

Figure 2:
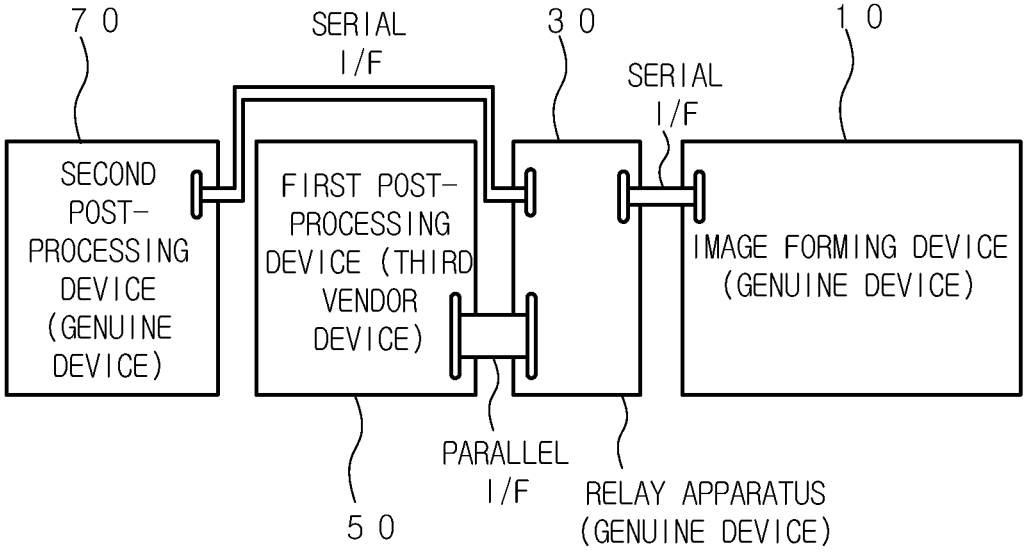
FIG. 2 shows the connection state of the communication lines in the image forming system according to the first embodiment.

FIG. 2 shows a connection state of the communication lines in the image forming system 5 shown in FIG. 1. The image forming device 10 and the relay apparatus 30 are connected through a serial interface which is compliant with the specifications of A manufacturer. The relay apparatus 30 and the first post-processing device 50 are connected through a parallel interface for the third vendor device. The relay apparatus 30 and the second post-processing device 70 are connected through the serial interface which is compliant with the specifications of A manufacturer and which is the same as the serial interface provided between the relay apparatus 30 and the image forming device 10.

Because the communication connection is performed through the parallel interface between the relay apparatus 30 and the first post-processing device 50, the amount of information to be exchanged is very small as compared to the serial interface. Further, the first post-processing device 50 and the second post-processing device 70 are not directly connected because of the communication therebetween.

Figure 3:
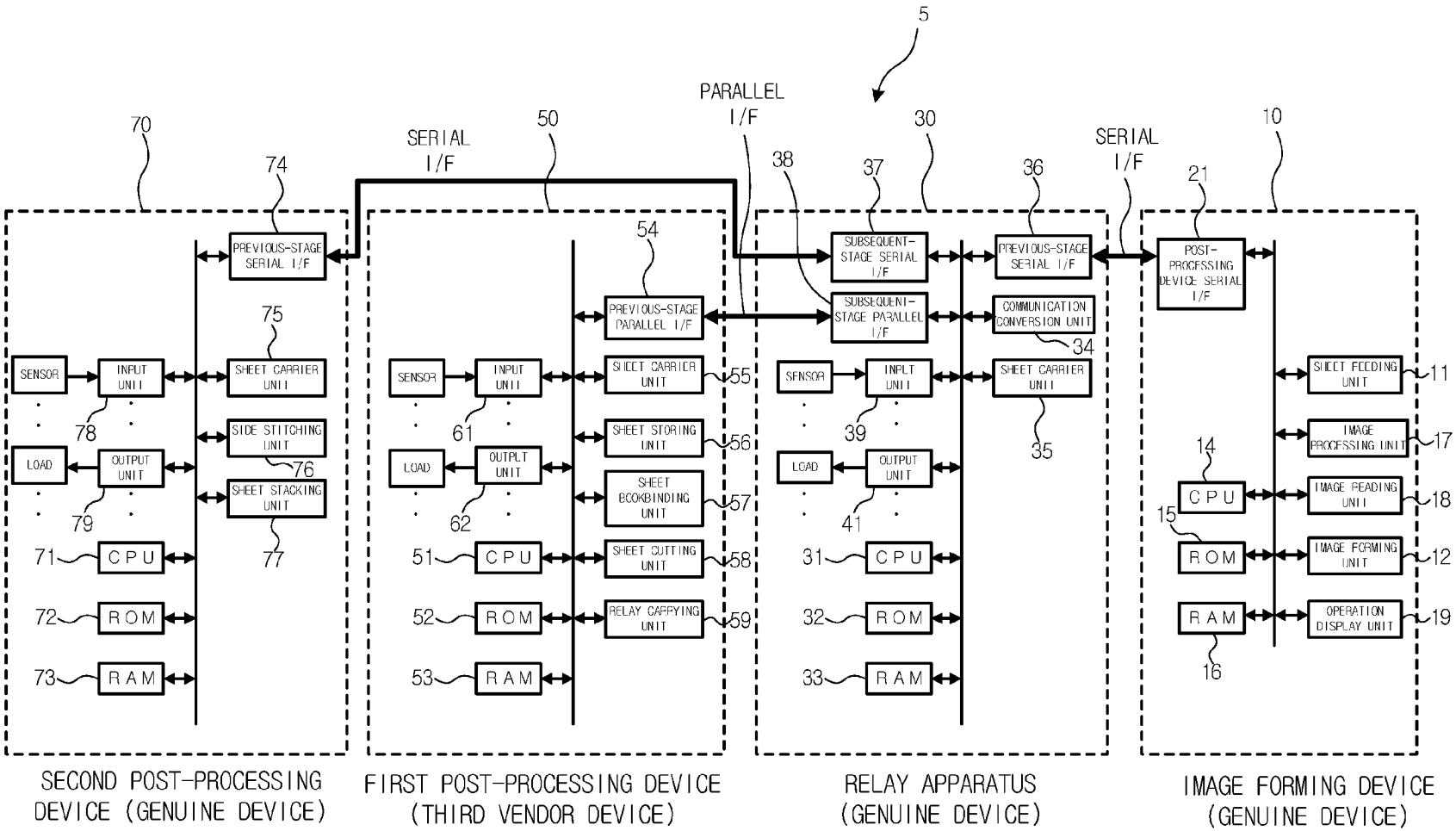
FIG. 3 is a block diagram showing an electrical outline configuration of each device of the image forming system according to the first embodiment.

FIG. 3 is a block diagram showing an outline configuration of each device of the image forming system 5 shown in FIGS. 1 and 2 according to the first embodiment. The image forming device 10 comprises a CPU (Central Processing Unit) 14 which totally controls the operations of the image forming device 10. The CPU 14 is connected to a ROM (Read Only Memory) 15, a RAM (Random Access Memory) 16, the sheet feeding unit 11, an image processing unit 17, an image reading unit 18, the image forming unit 12, an operation display unit 19, and a post-processing device serial interface unit 21 via a bus.

By the CPU 14, a middleware, application programs and the like are executed on an OS (Operating System) program as a base. In the ROM 15, various types of programs are stored. By executing the processes by the CPU 14 in accordance with these programs, various types of functions of the image forming device 10 are realized.

The RAM 16 is used as a work memory for temporarily storing various types of data when the CPU 14 executes the programs, an image memory for storing image data, and the like.

The image reading unit 18 has a function to optically read an original and acquire image data. For example, the image reading unit 18 comprises a light source for irradiating the original with light, a line image sensor for reading the original line by line in the width direction of the original by receiving the reflected light from the original, a moving unit for sequentially moving the reading position line by line in the longitudinal direction of the original, an optical system having lenses, mirrors and the like for guiding the reflected light from the original to the line image sensor and focusing the reflected light on the line image sensor, a converting unit for converting an analog image signal outputted from the line image sensor into digital image data, and the like.

The image forming unit 12 has a function to form an image on a sheet in accordance with print data. In the present embodiment, the image forming unit 12 is configured as the so-called laser printer for forming the image by the electrophotographic process. The laser printer comprises a carrier device of the recording sheets, a photoconductive drum 12*a*, a charging device, a laser unit, a developing device, transfer and separation device, a cleaning device, and a fixing unit. In the image forming unit 12, other types may be adopted.

The sheet feeding unit 11 comprises a sheet feed tray for storing a large number of sheets, and has a function to sequentially send the sheets stored in the sheet feed tray one by one to a carrier path leading into the image forming unit 12.

The image processing unit 17 carries out the rasterization processing for converting print data into image data, the compression/decompression processing of image data and the like, in addition to the processings, such as enlargement/reduction and rotation of the image.

The operation display unit 19 has a function to display various operation windows and setting windows, and receive various operations from a user. The operation display unit 19 comprises a display unit such as a liquid crystal display (LCD), various operation switches, and a touch screen which is provided on a display surface of the display unit and detects a pushed position.

Figure 21:
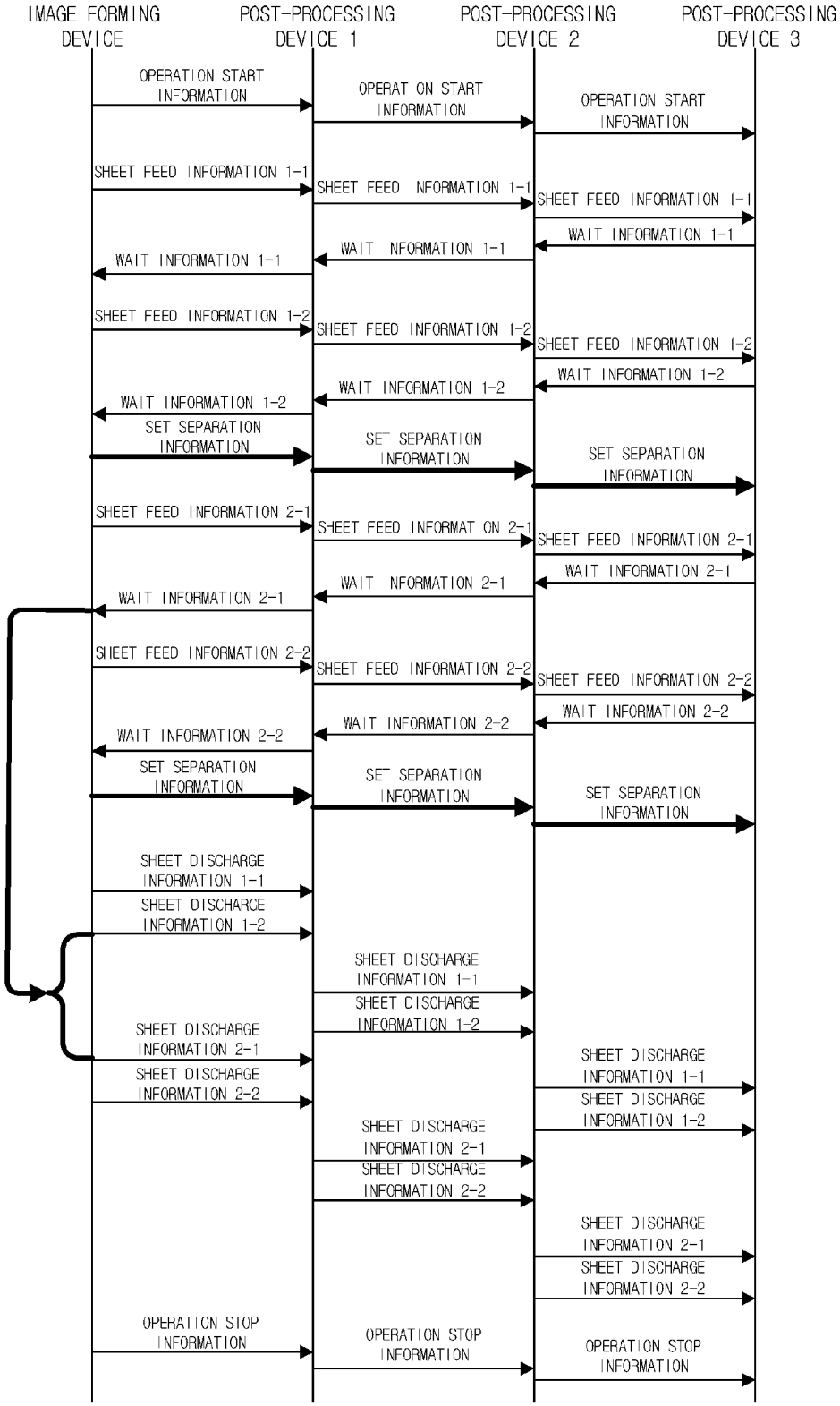
FIG.21 PRIOR ART
FIG. 21 shows a communication sequence in the image forming system shown in FIG. 20.
Figure 22:
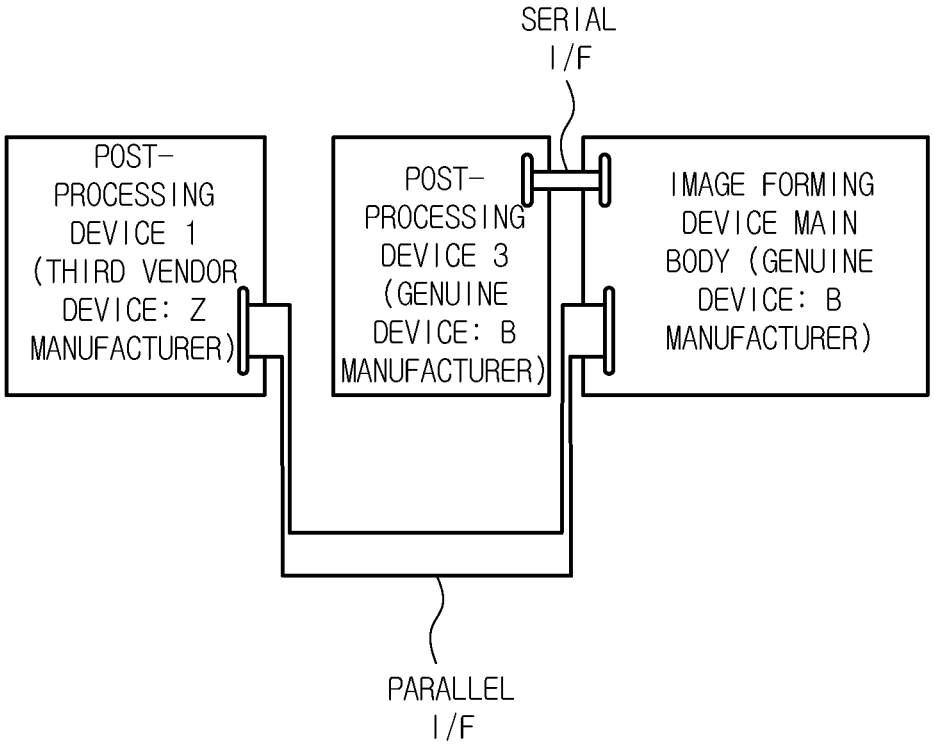
FIG.22 PRIOR ART
FIG. 22 shows an example of a conventional image forming system in which both of the serial interface and the parallel interface are provided on the image forming device.

The post-processing device serial interface unit 21 is a serial communication interface unit which exchanges various types of information with the post-processing device, and performs the communication by using the serial interface which is compliant with the specifications of A manufacturer. Through this serial interface, the image forming device 10 performs the communication sequence shown in FIG. 21, and controls the sheet discharge timing, that is, the timing of allowing a sheet to stand by at the standby position 13 (timing of releasing a standby state).

That is, the image forming device 10 notifies the subsequent-stage devices of the sheet feed information including the sheet information relating to the sheet and the contents of the post-processing to be performed to the sheet, at the timing of feeding the sheet from the sheet feeding unit 11 thereof. Further, the image forming device 10 receives the wait information as a response of the above notification. The wait information indicates the time necessary for the post-processing of the subsequent-stage device and the time equivalent to the sheet interval. The image forming device 10 allows the fed sheet to stand by at the standby position 13 provided in the carrier path, and releases the standby state and discharges the sheet so as to discharge it at the timing based on the time (sheet interval) indicated in the wait information notified by the subsequent-stage device. Further, the image forming device 10 outputs the set separation information in synchronization with the sheet feed information.

The relay apparatus 30 is configured by connecting a CPU 31 which totally controls operations of the relay apparatus 30, to a ROM 32, a RAM 33, a communication conversion unit 34, a sheet carrier unit 35, a previous-stage serial interface unit 36, a subsequent-stage serial interface unit 37, a subsequent-stage parallel interface unit 38, an input unit 39 which receives signals from various sensors, and an output unit 41 which outputs control signals to various loads such as a motor via a bus.

In the ROM 32, various types of programs are stored. By executing the processes by the CPU 31 in accordance with these programs, various types of functions of the relay apparatus 30 are realized. The RAM 33 is used as a work memory for temporarily storing various types of data when the CPU 31 executes process in accordance with the programs.

The sheet carrier unit 35 has a function to carry the sheet fed from the previous-stage device (image forming device 10) and discharge it to the subsequent-stage device (one step downstream device) (in this example, the first post-processing device 50).

The previous-stage serial interface unit 36 performs the serial communication (serial interface) for exchanging various types of information with the previous-stage device. The subsequent-stage serial interface unit 37 performs the serial communication for exchanging various types of information with the subsequent-stage device. The previous-stage serial interface unit 36 and the subsequent-stage serial interface unit 37 perform the communication by using the serial interfaces which are compliance with the specifications of A manufacturer. The subsequent-stage parallel interface unit 38 has a function to exchange various types of information with the subsequent-stage device by parallel communication (parallel interface). The subsequent-stage parallel interface unit 38 performs the communication via the parallel interface which is commonly used in the third vendor devices.

The communication conversion unit 34 performs the process for converting the contents of information and the transmission timing so as to absorb the difference in the communication procedures between the serial interface and the parallel interface. For example, in case that the post-processing device which is the third vendor device is connected to the subsequent stage through the parallel interface, when the sheet feed information is received from the upstream device through the serial interface, the relay apparatus 30 calculates the time corresponding to the sheet interval necessary for the post-processing device which is the third vendor device, and sends back the wait information indicating the calculated time to the upstream device. Further, the relay apparatus 30 has a function to receive the set separation information transmitted from the image forming device 10 in synchronization with the sheet feed information and to store the set separation information. Further, the relay apparatus 30 outputs the set separation information to the subsequent-stage post-processing device which is the third vendor device, at the timing based on the parallel interface for the third vendor device, that is, at the timing at which a final sheet of each set is discharged to the above subsequent-stage post-processing device.

The first post-processing device 50 which is the third vendor device is configured by connecting a CPU 51 which totally controls operations of the first post-processing device 50, to a ROM 52, a RAM 53, a previous-stage parallel interface unit 54, a sheet carrier unit 55, a sheet storing unit 56, a sheet bookbinding unit 57, a sheet cutting unit 58, a relay carrying unit 59, an input unit 61 which receives signals from various sensors, and an output unit 62 which outputs control signals to various loads such as a motor via a bus.

In the ROM 52, various types of programs are stored. By executing the processes by the CPU 51 in accordance with these programs, various types of functions of the first post-processing device 50 are realized. The RAM 53 is used as a work memory for temporarily storing various types of data when the CPU 51 executes process in accordance with the programs.

The previous-stage parallel interface unit 54 has a function to exchange various types of information with the previous-stage device by using the parallel communication. The previous-stage parallel interface unit 54 performs the communication via the parallel interface for the third vendor device.

The sheet carrier unit 55 carries the sheet fed from the previous-stage device (herein, the relay apparatus 30) to each post-processing unit in the first post-processing device 50. The sheet storing unit 56 has a function to store the post-processed sheet. The sheet bookbinding unit 57 has a function to bundle the sheets and bind a book. The sheet cutting unit 58 has a function to cut the sheet into a designated size. The relay carrying unit 59 has a function to carry the sheet fed from the previous-stage device and discharge it to the subsequent-stage device (herein, the second post-processing device 70).

The second post-processing device 70 which is the genuine device is configured by connecting the CPU 71 which totally controls operations of the second post-processing device 70, to a ROM 72, a RAM 73, a previous-stage serial interface unit 74, a sheet carrier unit 75, aside stitching unit 76, the sheet stacking unit 77, an input unit 78 which receives signals from various sensors, and an output unit 79 which outputs control signals to various loads such as a motor via a bus.

In the ROM 72, various types of programs are stored. By executing the processes by the CPU 71 in accordance with these programs, various types of functions of the second post-processing device 70 are realized. The RAM 73 is used as a work memory for temporarily storing various types of data when the CPU 71 executes process in accordance with the programs.

The previous-stage serial interface unit 74 has a function to exchange various types of information with the previous-stage device by using the serial communication. The previous-stage serial interface unit 74 performs the communication via the serial interface which is compliant with the specifications of A manufacturer.

The sheet carrier unit 75 carries the sheet fed from the previous-stage device (herein, the first post-processing device 50) to each post-processing unit in the second post-processing device 70. The side stitching unit 76 has a function to perform the side stitching for the sheets. The sheet stacking unit 77 has a function to stack the post-processed sheets (herein, the sheets to which the side stitching process is performed) on a sheet discharge tray or the like.

Figure 4:
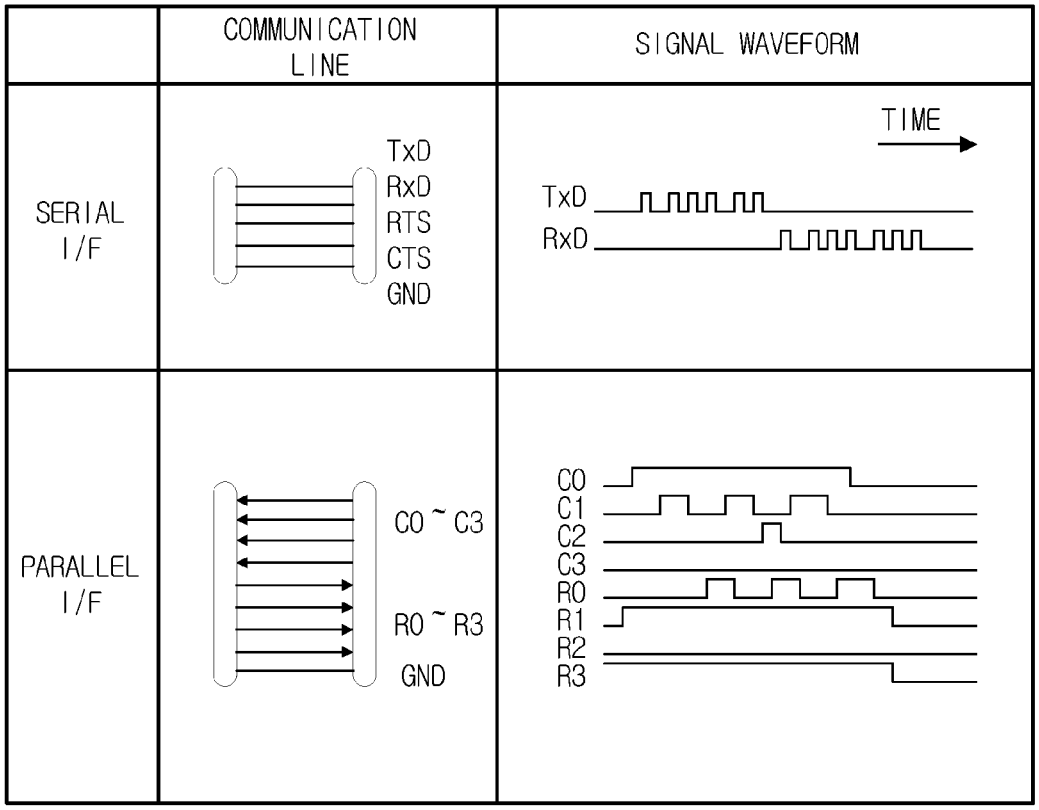
FIG. 4 is an explanatory view exemplifying the communication lines and the signals in the serial interface and the communication lines and the signals in the parallel interface.

FIG. 4 exemplifies the communication lines and the signals in the serial interface and the communication lines and the signals in the parallel interface. In the serial interface, data to be transmitted and data to be received are transmitted and received through a communication line T×D and a communication line R×D, respectively. In the serial interface, the number of communication lines is small, however, by transmitting and receiving data in series, the information having several bits can be transmitted and received. On the other hand, in the parallel interface of the present embodiment, only ON/OFF information having transmission 4 bits (C0 to C3)

and ON/OFF information having reception 4 bits (R0 to R3) can be transmitted and received. For example, the transmission 4 bits include an actuating signal for instructing the post-processing device to perform the ON/OFF operations, a sheet discharge signal switched to ON only during the time from starting discharging a front-end of the sheet until completing discharging a back-end of the sheet, and a set separation signal indicating a final sheet of the set of document to be printed. A number of known techniques relating to the serial interface and the parallel interface are known. Therefore, the detailed explanation thereof is omitted.

Figure 5:
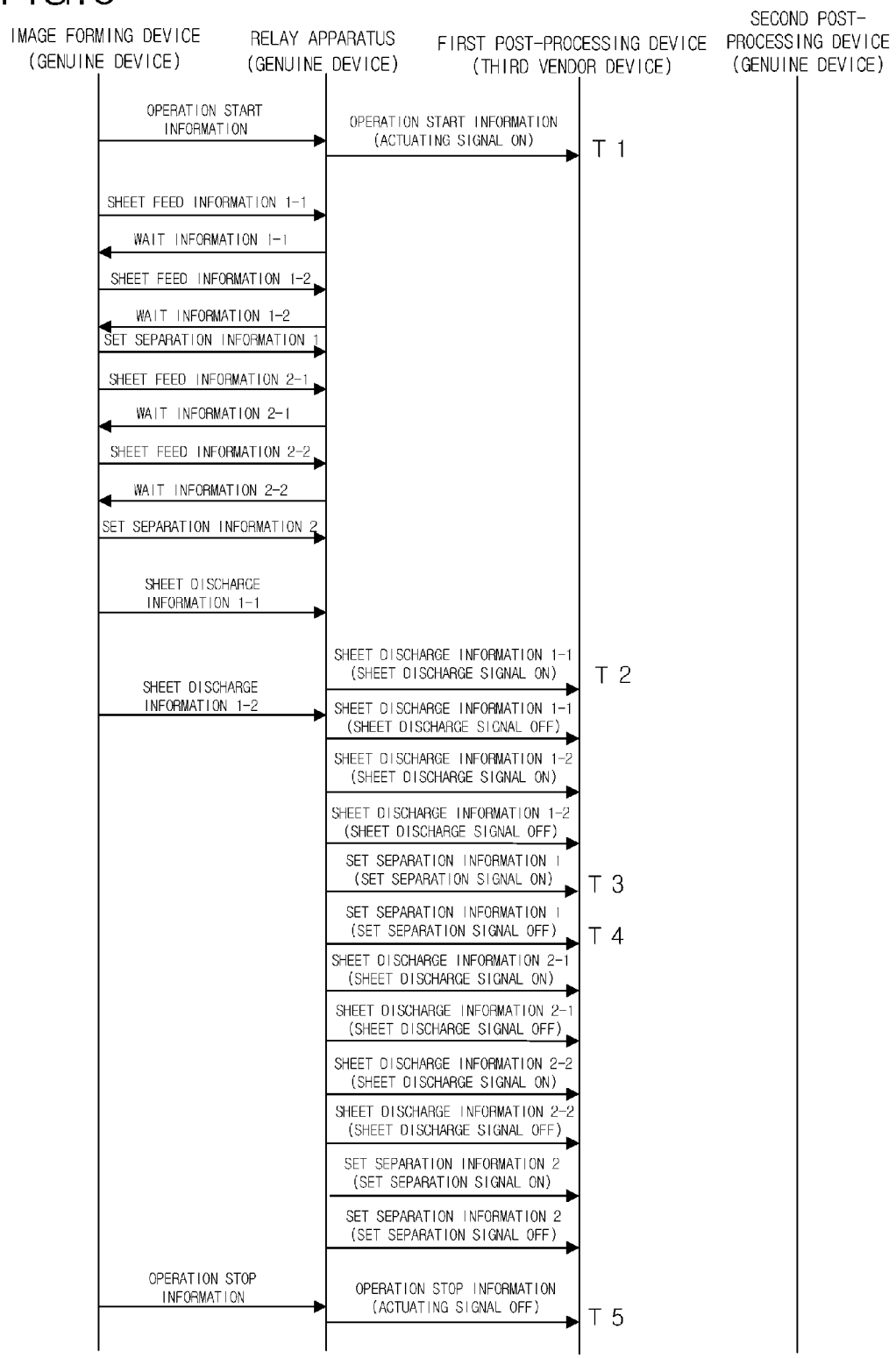
FIG. 5 shows a communication sequence in the case of creating two sets of brochures each of which has two sheets in the first post-processing device which is a third vendor device in the image forming system according to the first embodiment.

FIG. 5 shows a communication sequence in the case of creating two sets of brochures each of which has two sheets (two sets of brochures, one set of which has two sheets are created) in the first post-processing device 50 which is the third vendor device, of the image forming system 5 according to the first embodiment shown in FIGS. 1 to 3 (in the case where the discharge destination is set to the first post-processing device 50). In this operation example, all post-processing operations for creating brochures are completed in the first post-processing device 50 and the post-processing operation is not performed in the second post-processing device 70. Accordingly, sheets are not carried to the second post-processing device 70 and the finished brochures are discharged into the sheet storing unit 56 of the first post-processing device 50 to store them.

The image forming device 10 transmits the operation start information to the relay apparatus 30 through the serial interface. The operation start information includes the information indicating the contents of the post-processing and the identification data of the post-processing device to be started. In the present embodiment, as the operation start information, the relay apparatus 30 is notified that two sets of brochures, each of which has two sheets are created in the first post-processing device 50, and that the post-processing is not performed in the second post-processing device 70.

The relay apparatus 30 analyzes the operation start information received from the image forming device 10 and notifies the first post-processing device 50 to be started of the operation start information (actuating signal ON) through the parallel interface. The relay apparatus 30 does not transmit the operation start information to the second post-processing device 70.

Then, every when the sheet is fed, the image forming device 10 transmits the sheet feed information relating to the fed sheet to the relay apparatus 30. In addition, the image forming device 10 transmits the set separation information to the relay apparatus 30 in synchronization with the transmission of the sheet feed information relating to the final sheet of each set. In each drawing showing the communication sequence, the suffix added to each piece of information indicates that the sheet number of the sheet corresponding to the information and the set number of the set including the above sheet. To be more specific, "1-1", "1-2", "2-1", and "2-2" indicate a first sheet of a first set, a second sheet of the first set, a first sheet of a second set, and a second sheet of the second set, respectively. Further, the suffix added to the set separation information indicates the set number of the set corresponding to the set separation information.

Even if the relay apparatus 30 receives the sheet feed information from the image forming device 10, because the communication line to notify the first post-processing device 50 of the sheet feed information is not included in the parallel interface, the relay apparatus 30 does not notify the subsequent-stage first post-processing device 50 of this sheet feed information. Further, the subsequent-stage first post-processing device 50 has no function to notify the upstream devices of the wait information indicating the sheet interval necessary for the post-processing.

To solve the above problem, the relay apparatus 30 creates the wait information corresponding to the sheet feed information received from the image forming device 10 in place of the first post-processing device 50, and sends back the wait information to the image forming device 10. For example, when the sheet feed information 1-1 is received, the relay apparatus 30 creates the wait information 1-1 and sends back it to the image forming device 10. When the sheet feed information 1-2 is received, the relay apparatus 30 creates the wait information 1-2 and sends back it to the image forming device 10.

The relay apparatus 30 previously stores information relating to the sheet interval necessary for the post-processing device connected to the subsequent stage through the parallel interface (in the present embodiment, the first post-processing device 50), and creates the wait information based on the information and sends back it to the image forming device 10. For example, the relay apparatus 30 sets the sheet information (sheet size, paper type, and basis weight) and the contents of the post-processing, as parameters, and previously stores the sheet interval (wait information) corresponding to each combination of these values of the parameters in the storage unit as a table. When the sheet feed information is received, the relay apparatus 30 searches the sheet interval (wait information) corresponding to the combination of the sheet information indicated by the sheet feed information and the contents of the post-processing from the above table to read it, and sends back it to the upstream devices. As a memory location of the table, for example, the ROM 32 or a nonvolatile memory provided on the communication conversion unit 34 is used. The relay apparatus 30 may previously store the tables corresponding to various types of the post-processing devices which are the third vendor devices, in the storage unit and may select a table in accordance with the post-processing device which is the third vendor device to be actually used. For example, the above selection is performed after specific information relating to the post-processing device to be used is received from the image forming device 10 or is input from the user. Here, the wait information indicating the sheet interval is indicated by using the time.

When the set separation information transmitted in synchronization with the sheet feed information is received, the relay apparatus 30 temporarily stores the set separation information in the RAM 33 and the like to buffer it. Then, the relay apparatus 30 outputs the set separation signal in synchronization with the sheet discharge signal of the final sheet of each set.

Based on the wait information received from the relay apparatus 30, the image forming device 10 controls the standby time at the standby position 13. Thereby, the sheet is discharged at the timing indicated by the wait information.

The image forming device 10 outputs the sheet discharge information to the relay apparatus 30 at the timing at which the sheet is actually discharged to the relay apparatus 30. The relay apparatus 30 comprises a sheet discharge sensor which is provided at the carrier outlet of the relay apparatus 30 and which detects a front-end and a back-end of the sheet to be discharged from the carrier outlet. Based on the detection state of this sheet discharge sensor, the relay apparatus 30 outputs the sheet discharge information to the first post-processing device 50 through the parallel interface every when the sheet is discharged to the subsequent-stage first post-processing device 50 from the relay apparatus 30. Specifically, when the front-end of the sheet is discharged from the carrier outlet, the relay apparatus 30 switches the sheet discharge signal to ON. On the other hand, when the back-end of the sheet is discharged from the carrier outlet, the relay apparatus 30 switches the sheet discharge signal to OFF. The first post-processing device 50 is not notified of the information indicating the sheet number of the discharged sheet, the set number of the set including the discharged sheet, and the type of the discharged sheet.

Further, the relay apparatus 30 outputs the set separation information at the timing at which the final sheet of each set is discharged from the carrier outlet of the relay apparatus 30. To be more specific, when the sheet discharge sensor detects a back-end of the final sheet of the set, the relay apparatus 30 switches the set separation signal to ON. On the other hand, when the sheet discharge sensor detects a front-end of a first sheet of the next set, the relay apparatus 30 switches the set separation signal to OFF. As described above, the set separation signal is output in synchronization with the sheet discharge signal.

By the sheet discharge signal from the relay apparatus 30, the first post-processing device 50 which is the third vendor device, recognizes that the sheet is carried from the upstream device. By the set separation signal from the relay apparatus 30, the first post-processing device 50 recognizes the separation of the set and performs the post-processing and carrier operations to the sheets one by one or set by set.

After the image forming device 10 completes the discharge of the second sheet of the second set, the image forming device 10 transmits the operation stop information to the relay apparatus 30. After the relay apparatus 30 receiving the operation stop information completes the discharge of the second sheet of the second set to the subsequent-stage device (the first post-processing device 50), the relay apparatus 30 transmits the operation stop information to the first post-processing device 50. Specifically, the relay apparatus 30 switches the actuating signal to OFF. The relay apparatus 30 does not transmit the operation stop information to the second post-processing device 70.

Figure 6:
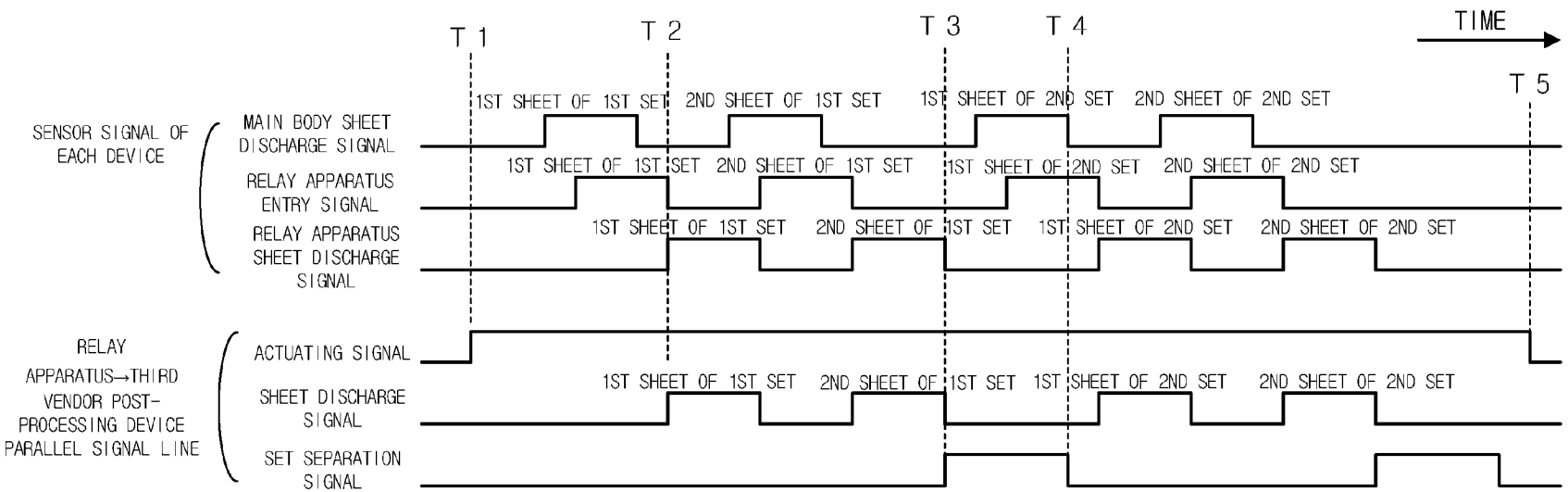
FIG. 6 is a timing chart showing the change in each signal of the parallel interface, which is output to the first post-processing device from the relay apparatus in the case of the communication sequence of FIG. 5.

FIG. 6 is a timing chart indicating the change and the like in each signal output from the relay apparatus 30 to the first post-processing device 50 through the parallel interface in the case where the operations are performed in the communication sequence of FIG. 5. The upper three signals shown in FIG. 6 are the main body sheet discharge signal output from the sheet discharge sensor provided on the carrier outlet of the image forming device 10, the relay apparatus entry signal output from the carrier sensor provided on the carrier inlet of the relay apparatus 30, the relay apparatus sheet discharge signal output from the sheet discharge sensor provided on the carrier outlet of the relay apparatus 30. Further, the lower three signals are the actuating signal, the sheet discharge signal, and the set separation signal which are output from the relay apparatus 30 to the first post-processing device 50. When the signal level is High, the status of each signal is ON. On the other hand, when the signal level is Low, the status of each signal is OFF.

The timings indicated by T1 to T5 of FIG. 6 correspond to the timings indicated by T1 to T5 of FIG. 5, respectively. The actuating signal, the sheet discharge signal, and the set separation signal correspond to C0, C1, and C2 of the parallel interface shown in FIG. 4, respectively.

Figure 7:
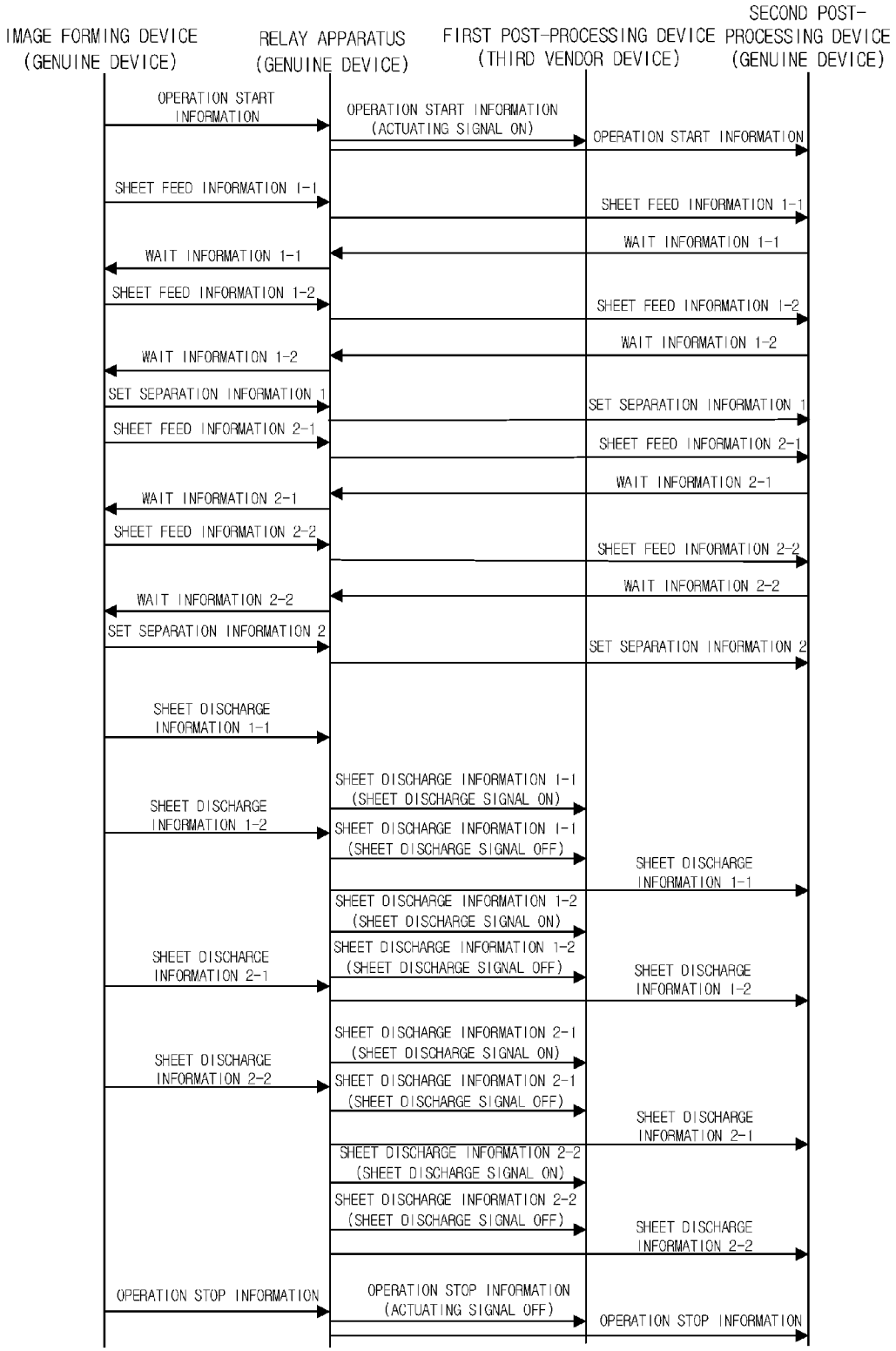
FIG. 7 shows a communication sequence in the case where the sheets is carried by the bypass conveyance in the first post-processing device and two sets of brochures each of which has two sheets are created in the second post-processing device which is a genuine device, in the image forming system according to the first embodiment.

FIG. 7 shows a communication sequence in the case where the sheet is carried by the bypass conveyance in the first post-processing device 50 and two sets of brochures each of which has two sheets are created in the second post-processing device 70 which is the genuine device (in case that the discharge destination is the second post-processing device 70) in the image forming system 5 shown in FIGS. 1 to 3 according to the first embodiment. In this operation, the first post-processing device 50 allows the sheet carried from the image forming device 10 to directly pass through the inside thereof and discharges the sheet to the subsequent-stage second post-processing device 70. Then, the post-processing is performed in the second post-processing device 70.

The image forming device 10 transmits the operation start information to the relay apparatus 30 through the serial interface. The relay apparatus 30 analyzes the operation start information received from the image forming device 10 and transmits it to both of the first and second post-processing devices 50 and 70 to be started. Specifically, the relay apparatus 30 notifies the first post-processing device 50 of the operation start information by switching the actuating signal of the parallel interface to ON, and directly transmits the operation start information received from the image forming device 10 to the second post-processing device 70 through the serial interface.

Then, every when the sheet is fed, the image forming device 10 transmits the sheet feed information relating to the sheet to the relay apparatus 30. Further, the image forming device 10 synchronizes the set separation information with the sheet feed information relating to the final sheet of each set, and transmits the set separation information to the relay apparatus 30. The first post-processing device 50 which is the third vendor device cannot receive the sheet feed information from the relay apparatus 30. Further, the first post-processing device 50 cannot receive the wait information. Therefore, the relay apparatus 30 which receives the sheet feed information from the image forming device 10 calculates the wait time necessary for the first post-processing device 50 with reference to the table stored in the storage unit, as described above.

The second post-processing device 70 has the serial interface which is compliant with the specifications of A manufacturer, and sends back the wait information in response to the sheet feed information received from the upstream device. The relay apparatus 30 then transmits (transfers) the sheet feed information received from the image forming device 10 to the second post-processing device 70 through the serial interface, and receives the wait information from the second post-processing device 70. In addition, the relay apparatus 30 synchronizes the set separation information with the sheet feed information relating to the final sheet of each set, and transmits the set separation information to the second post-processing device 70.

The relay apparatus 30 compares the time indicated by the wait information received from the second post-processing device 70 and the wait time necessary for the first post-processing device 50, which is calculated by the relay apparatus 30, and notifies the image forming device 10 of the larger time as the wait information.

By controlling the standby time at the standby position 13 based on the received wait information, the image forming device 10 discharges the sheet at the timing indicated by the wait information.

The image forming device 10 outputs the sheet discharge information to the relay apparatus 30 at the timing at which the sheet is actually discharged to the relay apparatus 30. Similarly to the case shown in FIG. 5, based on the detection state of the sheet discharge sensor provided on the carrier outlet of the relay apparatus 30, the relay apparatus 30 outputs the sheet discharge information to the first post-processing device 50 through the parallel interface every when the sheet is discharged from the relay apparatus 30 to the subsequent-stage first post-processing device 50. Specifically, when a front-end of the sheet is discharged from the carrier outlet, the relay apparatus 30 switches the sheet discharge signal to ON. On the other hand, when a back-end of the sheet is discharged from the carrier outlet, the relay apparatus 30 switches the sheet discharge signal to OFF. Because the sheet is only carried by the bypass conveyance in the first post-processing device 50, the relay apparatus 30 does not transmit the set separation information to the first post-processing device 50.

By the received sheet discharge signal, the first post-processing device 50 which is the third vendor device recognizes that the sheet is carried from the upstream device, and this sheet is carried by the bypass conveyance in the first post-processing device 50. When the sheet is discharged to the subsequent-stage second post-processing device 70, the first post-processing device 50 cannot notify the subsequent-stage second post-processing device 70 of the sheet discharge information (sheet discharge signal). To solve the above problem, in consideration of the carrying time through the first post-processing device 50, the relay apparatus 30 notifies the second post-processing device 70 of the sheet discharge information. Here, the relay apparatus 30 previously stores the carrying time in the case where the sheet is carried by the bypass conveyance in the first post-processing device 50. When the carrying time elapses since the front-end of the sheet is discharged from the relay apparatus 30, the relay apparatus 30 transmits the sheet discharge information to the second post-processing device 70 through the serial interface.

After the discharge of the second sheet of the second set is completed, the image forming device 10 transmits the operation stop information to the relay apparatus 30. After the relay apparatus 30 receiving the operation stop information completes the discharge of the second sheet of the second set to the first post-processing device 50, the relay apparatus 30 transmits the operation stop information to the first post-processing device 50. Specifically, the relay apparatus 30 switches the actuating signal to OFF. The relay apparatus 30 further transmits (transfers) the operation stop information received from the image forming device 10 to the second post-processing device 70.

Figure 8:
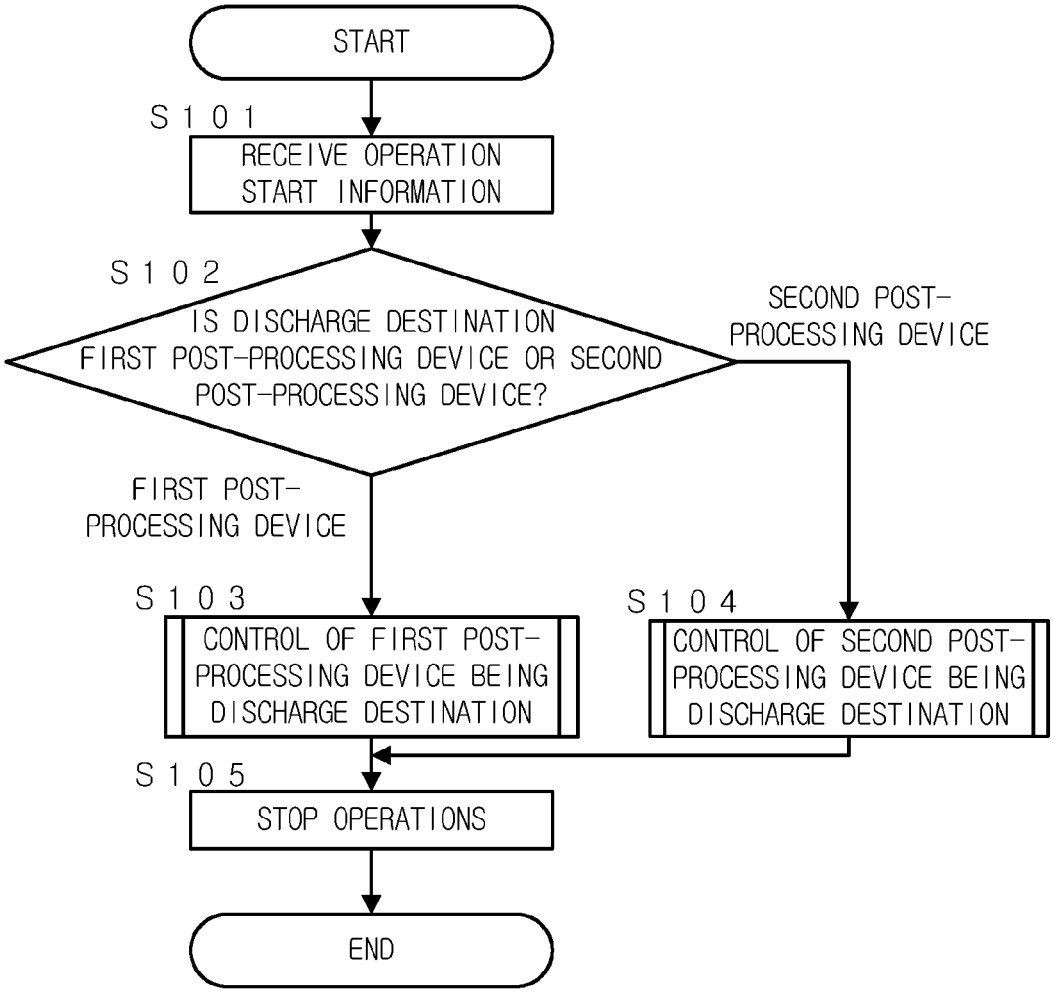
FIG. 8 is a flowchart showing a main process performed by the relay apparatus of the image forming system according to the first embodiment.

FIG. 8 shows a flowchart of the main process performed by the relay apparatus 30 of the image forming system 5 according to the first embodiment. When the operation start information is received from the image forming device 10 (Step S101), the relay apparatus 30 analyzes this operation start information, and determines whether the discharge destination of the sheet after the completion of the post-processing is the first post-processing device 50 or the second post-processing device 70 (Step S102). When the discharge destination is the first post-processing device 50 (Step S102; first post-processing device), the relay apparatus 30 executes "control of first post-processing device being discharge destination" (Step S103). In this case, the operations are performed in the communication sequence shown in FIG. 5. When the discharge destination is the second post-processing device 70 (Step S102; second post-processing device), the relay apparatus 30 executes "control of second post-processing device being discharge destination" (Step S104). In this case, the operations are performed in the communication sequence shown in FIG. 7. After the process of step S103 or S104 is completed, the relay apparatus 30 stops the operations (Step S105). Then, the process is ended.

Figure 9:
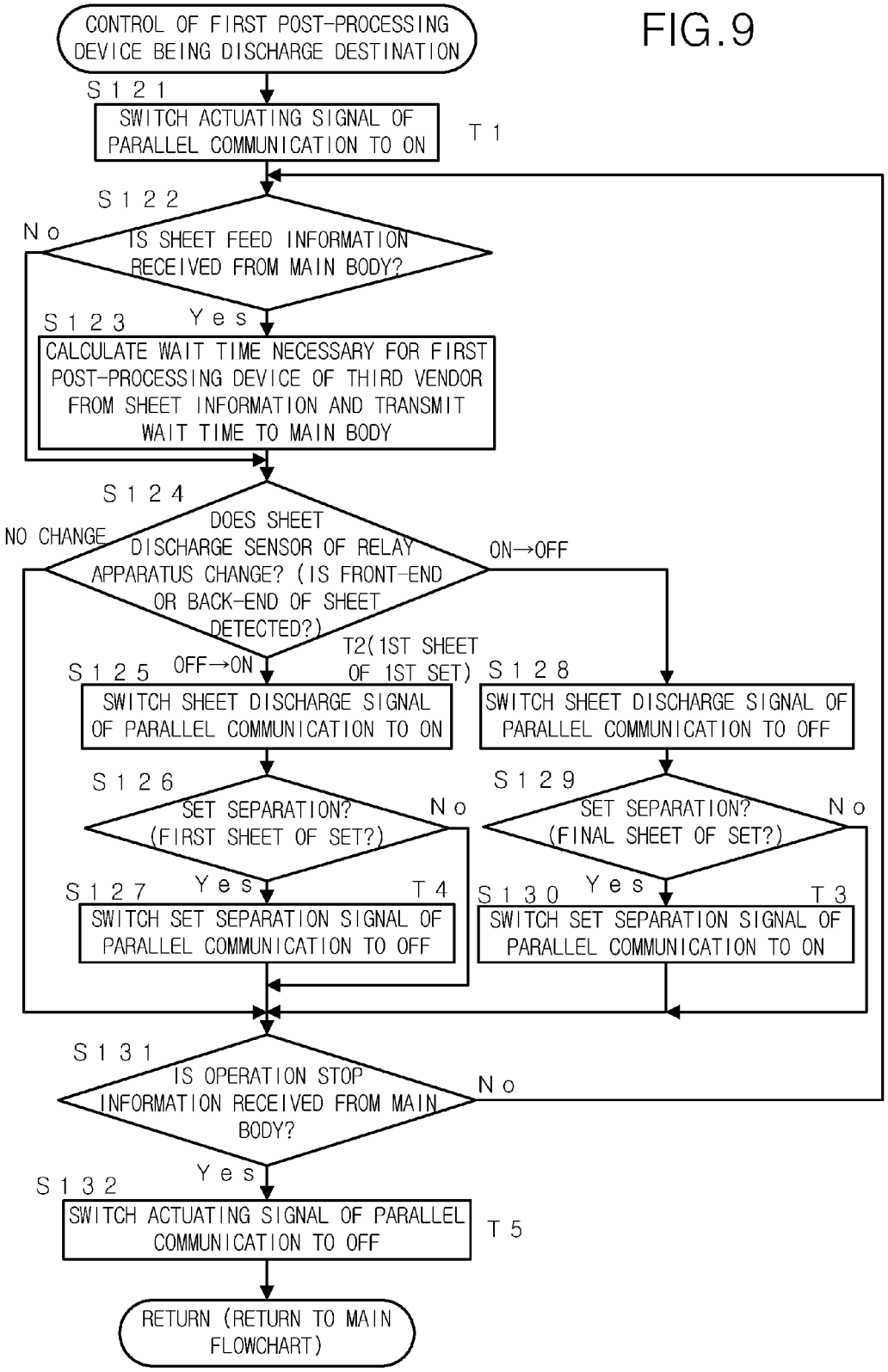
FIG. 9 is a flowchart showing details of a process of "control of first post-processing device being discharge destination

FIG. 9 is a flowchart showing the details of "control of first post-processing device being discharge destination" (FIG. 8: Step S103). The relay apparatus 30 switches the actuating signal of the parallel communication (parallel interface) to ON by using the subsequent-stage parallel interface unit 38 (Step S121). Next, when the sheet feed information is received from the image forming device 10 (in the drawings, referred to as a "main body") (Step S122; Yes), the relay apparatus 30 calculates the wait time necessary for the first post-processing device 50 which is the third vendor device, in accordance with the sheet information included in this sheet feed information. Then, the relay apparatus 30 transmits the wait information indicating the wait time to the image forming device 10 (Step S123), and the process proceeds to step S124.

In case that the sheet feed information is not received from the image forming device 10 (Step S122; No), the process proceeds to step S124.

At step S124, the relay apparatus 30 determines whether the sheet discharge sensor of the relay apparatus 30 changes. When the sheet discharge sensor does not change (Step S124: No change), the process proceeds to step S131. When the sheet discharge sensor changes from OFF to ON (Step S124; OFF→ON), because the front-end of the sheet is detected, the relay apparatus 30 switches the sheet discharge signal of the parallel communication to ON (Step S125). Further, the relay apparatus 30 determines whether this sheet is a first sheet of the set (Step S126). When this sheet is the first sheet (Step S126; Yes), the relay apparatus 30 switches the set separation signal of the parallel communication to OFF (Step S127), and the process proceeds to step 131. When this sheet is not the first sheet (Step S126; No), the process proceeds to step S131.

When the sheet discharge sensor changes from ON to OFF (Step S124; ON→OFF), because the back-end of the sheet is detected, the relay apparatus 30 switches the sheet discharge signal of the parallel communication to OFF (Step S128). Further, the relay apparatus 30 determines whether this sheet is a final sheet of the set (Step S129). When this sheet is the final sheet (Step S129; Yes), the relay apparatus 30 switches the set separation signal of the parallel communication to ON (Step S130), and the process proceeds to step 131. When this sheet is not the final sheet (Step S129; No), the process proceeds to step S131.

At step S131, the relay apparatus 30 determines whether to receive the operation stop information from the image forming device 10. In case that the relay apparatus 30 does not receive the operation stop information (Step S131; No), the process returns to step S122 and is continued. When the relay apparatus 30 receives the operation stop information (Step S131; Yes), the relay apparatus 30 switches the actuating signal of the parallel communication to OFF (Step S132), and the process returns to the process shown in FIG. 8 (return). The references T1 to T5 of FIG. 9 indicate the timings corresponding to T1 to T5 of FIG. 6.

Figure 10:
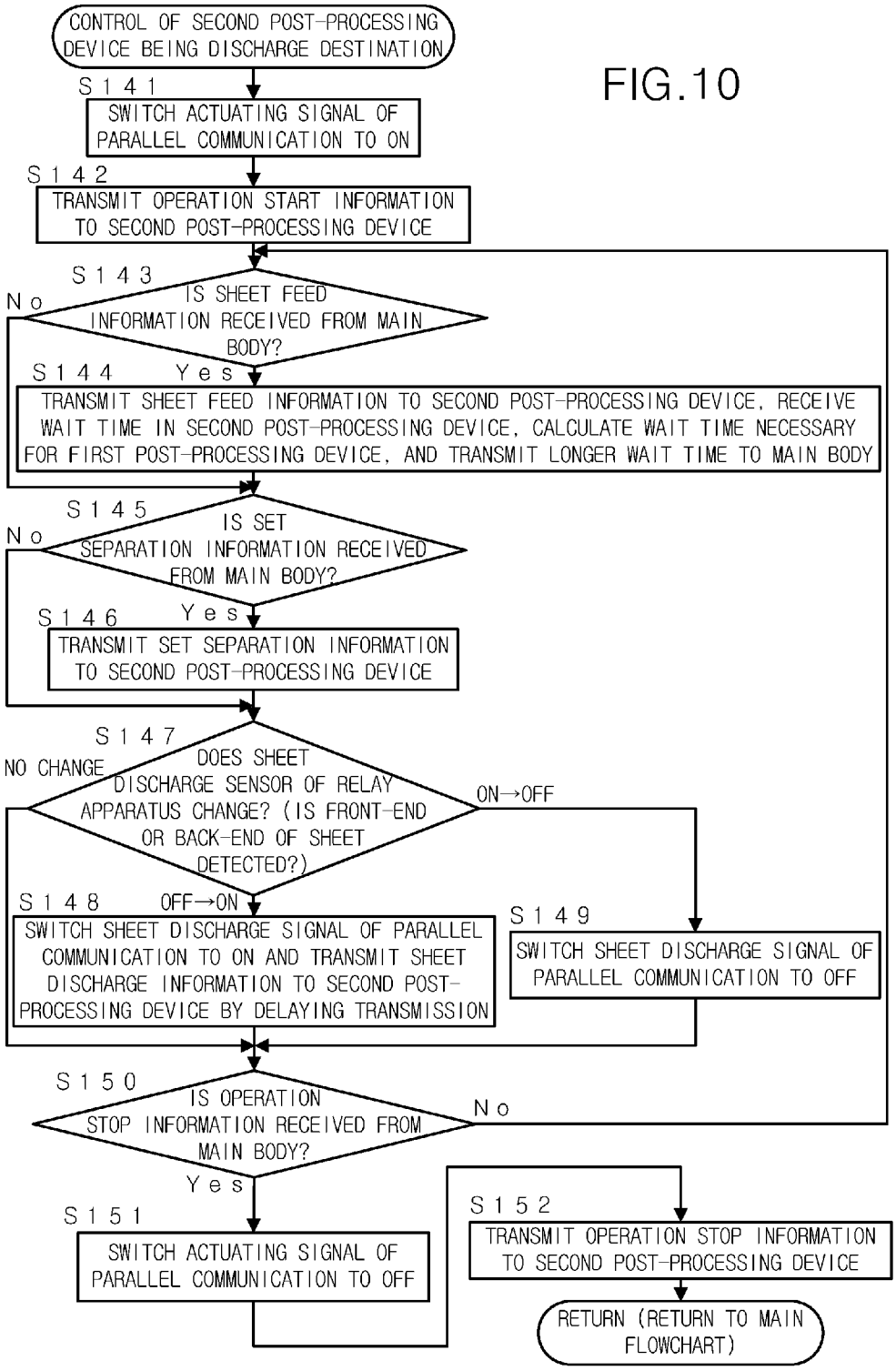
FIG. 10 is a flowchart showing details of a process of "control of second post-processing device being discharge destination

FIG. 10 is a flowchart showing the details of "control of second post-processing device being discharge destination" (FIG. 8: Step S104). The relay apparatus 30 switches the actuating signal of the parallel communication (parallel interface) to ON by using the subsequent-stage parallel interface unit 38 (Step S141). At the same time, the relay apparatus 30 transfers the operation start information from the subsequent-stage serial interface unit 37 to the subsequent-stage second post-processing device 70 by the serial communication (serial interface) (Step S142).

Next, when the sheet feed information is received from the image forming device 10 (main body) (Step S143; Yes), the relay apparatus 30 transmits this sheet feed information to the second post-processing device 70 through the serial communication using the subsequent-stage serial interface unit 37, and receives the wait information from the second post-processing device 70. Further, the relay apparatus 30 calculates the wait time necessary for the first post-processing device 50 which is the third vendor device, in accordance with the sheet information received from the image forming device 10 at step S143. The relay apparatus 30 transmits the longer wait time of the calculated wait time and the wait time indicated by the wait information received from the second post-processing device 70, to the image forming device 10 (Step S144). Then, the process proceeds to step S145. In case that the sheet feed information is not received from the image forming device 10 (Step S143; No), the relay apparatus 30 does not perform the above process, and the process proceeds to step S145.

At step S145, the relay apparatus 30 determines whether to receive the set separation information from the image forming device 10. In case that the relay apparatus 30 does not receive the set separation information (Step S145; No), the process proceeds to step S147. When the relay apparatus 30 receives the set separation information (Step S145; Yes), the relay apparatus 30 transmits the set separation information to the second post-processing device 70 (Step S146), and the process proceeds to step S147. The relay apparatus 30 does not transmit the set separation information to the first post-processing device 50.

At step S147, the relay apparatus 30 determines whether the sheet discharge sensor of the relay apparatus 30 changes. When the sheet discharge sensor does not change (Step S147: No change), the process proceeds to step S150. When the sheet discharge sensor changes from OFF to ON (Step S147; OFF→ON), the relay apparatus 30 switches the sheet discharge signal of the parallel communication to ON. Further, the relay apparatus 30 counts the time until the sheet is discharged from the first post-processing device 50 which is the third vendor device. When the count is completed (the count reaches a specified count value), the relay apparatus 30 transmits the sheet discharge information to the second post-processing device 70 (Step S148), and the process proceeds to step 150.

When the sheet discharge sensor changes from ON to OFF (Step S147; ON→OFF), the relay apparatus 30 switches the sheet discharge signal of the parallel communication to OFF (Step S149), and the process proceeds to step S150.

At step S150, the relay apparatus 30 determines whether to receive the operation stop information from the image forming device 10. In case that the relay apparatus 30 does not receive the operation stop information (Step S150; No), the process returns to step S143 and is continued. When the relay apparatus 30 receives the operation stop information (Step S150; Yes), the relay apparatus 30 switches the actuating signal of the parallel communication to OFF (Step S151) and transmits the operation stop information to the second post-processing device 70 (Step S152). Then, the process returns to the process shown in FIG. 8 (return).

Second Embodiment

In the second embodiment, the ground heights of the carrier outlet and the carrier inlet of the genuine device are different from those of the third vendor device. The difference between the ground heights is absorbed by the relay apparatus interposed between the devices.

Figure 11:
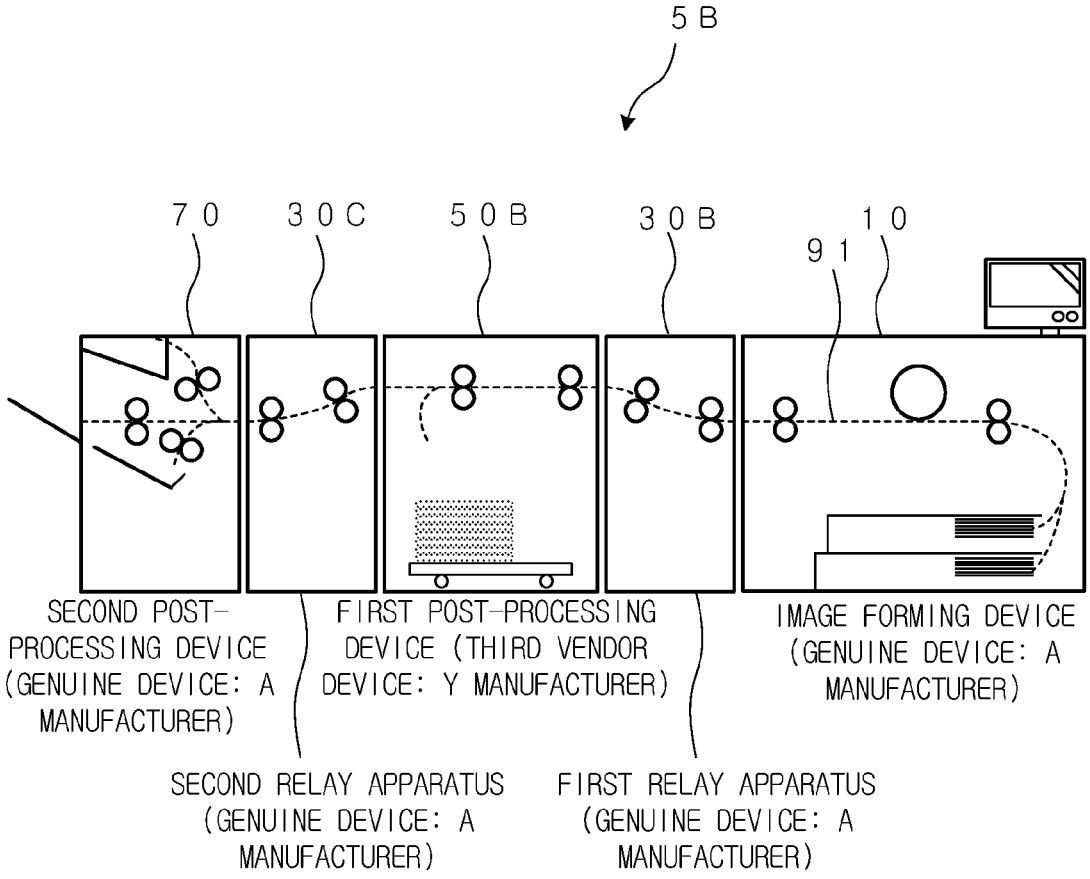
FIG. 11 shows a system configuration example of the image forming system according to the second embodiment.

FIG. 11 shows a system configuration example of the image forming system 5B according to the second embodiment. The image forming system 5B is configured by connecting a first relay apparatus 30B which is the genuine device of A manufacturer, a first post-processing device 50B which is a post-processing device of the third vendor (Y manufacturer), a second relay apparatus 30C which is the genuine device of A manufacturer, and a second post-processing device 70 which is the genuine device of A manufacturer to a subsequent stage (downstream) of the image forming device 10 which is the genuine device of A manufacturer in this order so as to connect the carrier path 91 in series.

The image forming device 10 and the second post-processing device 70 which are the genuine devices of A manufacturer are different from the first post-processing device 50B which is the third vendor device manufactured by Y manufacturer in the ground heights of the carrier outlet and the carrier inlet. Therefore, the first relay apparatus 30B which is the genuine device of A manufacturer is interposed between the image forming device 10 and the first post-processing device 50B. Further, the second relay apparatus 30C which is the genuine device of A manufacturer is interposed between the first post-processing device 50B and the second post-processing device 70 so as to absorb the difference in the ground height and connect the carrier path 91.

In the present example, the ground heights of the carrier outlet and the carrier inlet of the first post-processing device 50B are higher than those of the carrier outlets and the carrier inlets of the genuine devices of A manufacturer. The ground height of the carrier inlet of the first relay apparatus 30B is the same as the ground height of the genuine device of A manufacturer (the ground height of the carrier outlet of the image forming device 10). The ground height of the carrier outlet of the first relay apparatus 30B is higher than the ground height of the genuine device of A manufacturer, and is the same as that of the carrier inlet of the first post-processing device 50B. The ground height of the carrier inlet of the second relay apparatus 30C is the same as that of the carrier outlet of the first post-processing device SOB. The ground height of the carrier outlet of the second relay apparatus 30C is lower than that of the carrier outlet of the first post-processing device 50B, and is the same as the ground height of the genuine device of A manufacturer (the ground height of the carrier inlet of the second post-processing device 70).

Figure 12:
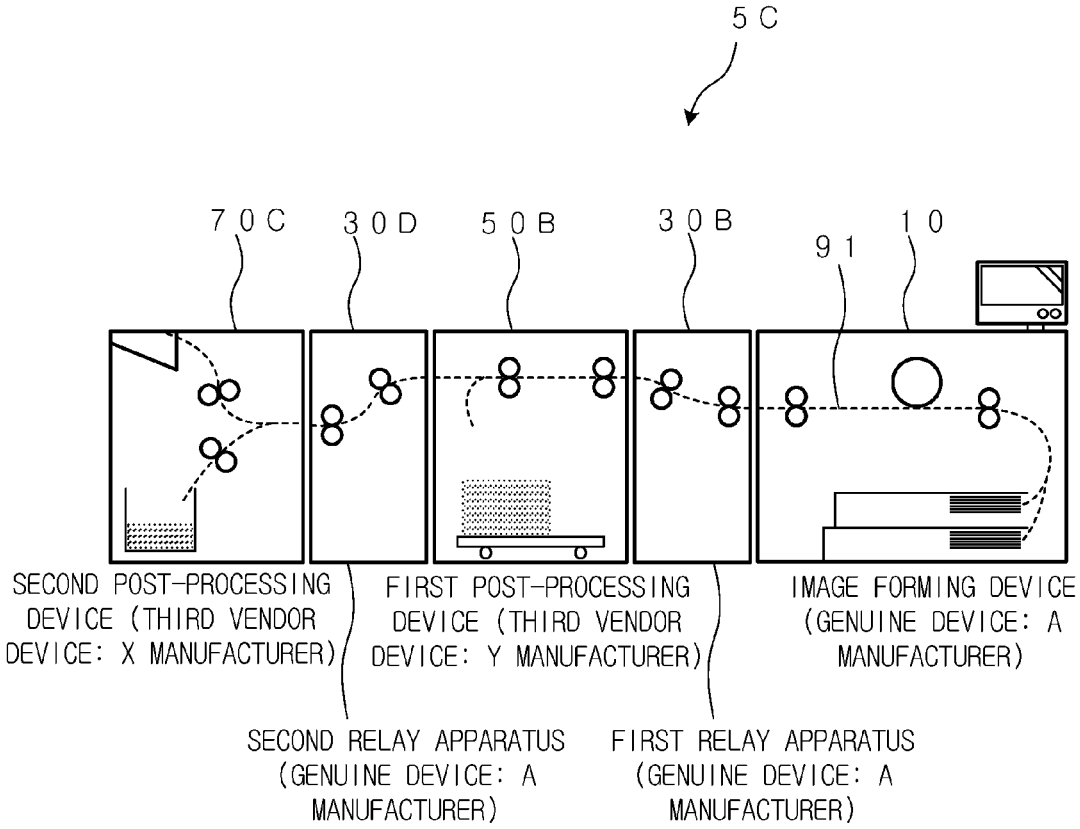
FIG. 12 shows another configuration example of the image forming system according to the second embodiment.

FIG. 12 shows an image forming system 5C as another system configuration example according to the second embodiment. The image forming system 5C is configured by connecting the first relay apparatus 30B which is the genuine device of A manufacturer, the first post-processing device 50B which is the post-processing device of the third vendor (Y manufacturer), a second relay apparatus 30D which is the genuine device of A manufacturer, and a second post-processing device 70C which is a post-processing device of a third vendor (X manufacturer) to a subsequent stage (downstream) of the image forming device 10 which is the genuine device of A manufacturer in this order so as to connect the carrier path 91 in series.

The image forming device 10 which is the genuine device of A manufacturer, the first post-processing device 50B which is the third vendor device of Y manufacturer, and the second post-processing device 70C which is the third vendor device of X manufacturer are different in the ground heights of the carrier outlets and the carrier inlets, respectively. Therefore, the first relay apparatus 30B which is the genuine device of A manufacturer is interposed between the image forming device 10 and the first post-processing device 50B. Further, the second relay apparatus 30D which is the genuine device of A manufacturer is interposed between the first post-processing device 50B and the second post-processing device 70C so as to absorb the difference in the ground height and connect the carrier path 91.

In the present example, the ground heights of the carrier outlet and the carrier inlet of the first post-processing device 50B are higher than those of the carrier outlets and the carrier inlets of the genuine devices of A manufacturer, and the ground height of the carrier inlet of the second post-processing device 70C is lower than the ground height of the genuine devices of A manufacturer. The ground height of the carrier inlet of the first relay apparatus 30B is the same as the ground height of the genuine device of A manufacturer (the ground height of the carrier outlet of the image forming device 10). The ground height of the carrier outlet of the first relay apparatus 30B is higher than the ground height of the genuine device of A manufacturer, and is the same as that of the carrier inlet of the first post-processing device 50B. The ground height of the carrier inlet of the second relay apparatus 30D is the same as that of the carrier outlet of the first post-processing device 50B. The ground height of the carrier outlet of the second relay apparatus 30D is the same as that of the carrier inlet of the second post-processing device 70C which has the ground height lower than the ground height of the genuine device of A manufacturer (the ground height of the carrier inlet of the second post-processing device 70).

Figure 13:
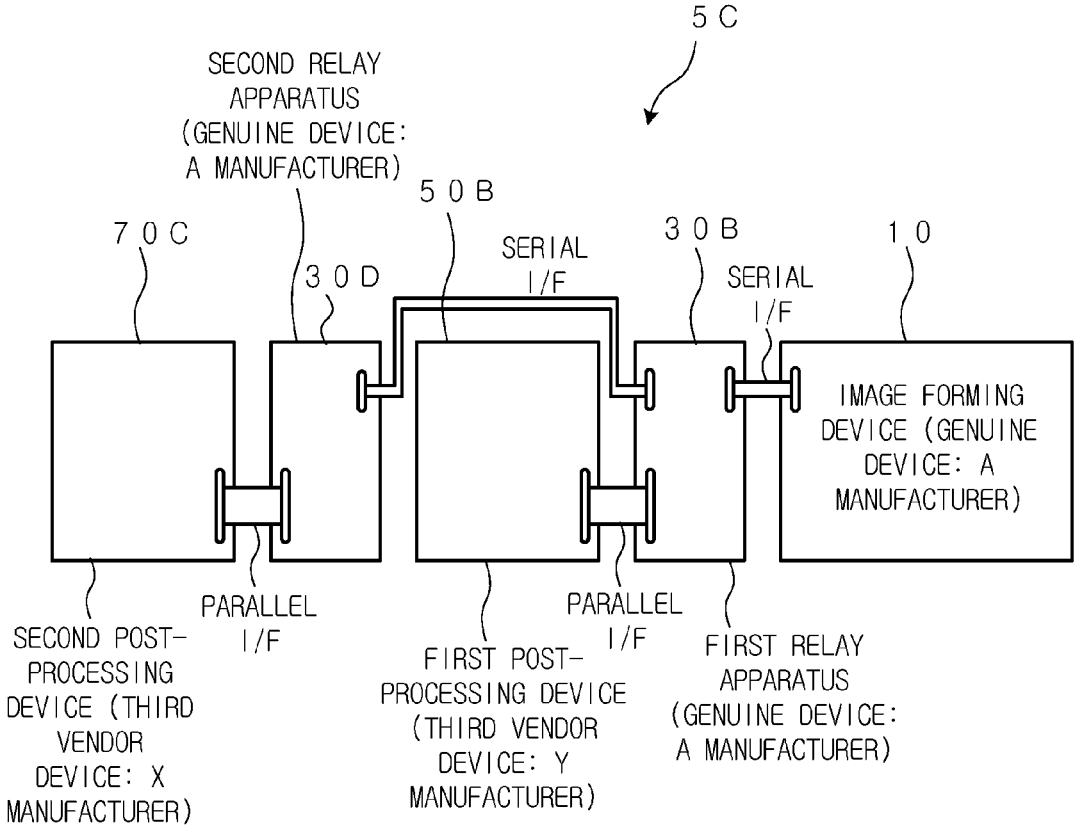
FIG. 13 shows the connection state of the communication lines in the image forming system shown in FIG. 12.

FIG. 13 shows a connection state of the communication lines in the image forming system 5C shown in FIG. 12. The first post-processing device 50B manufactured by the third vendor (Y manufacturer) has no interface with the subsequent-stage device. The image forming device 10 and the first relay apparatus 30B are connected through the serial interface which is compliant with the specifications of A manufacturer. The first relay apparatus 30B and the first post-processing device 50B are connected through the parallel interface for the third vendor device. The first relay apparatus 30B and the second relay apparatus 30D are connected through the serial interface which is compliant with the specifications of A manufacturer. The second relay apparatus 30D and the second post-processing device 70C which is manufactured by the third vendor (X manufacturer) are connected through the parallel interface for the third vendor device.

Figure 14:
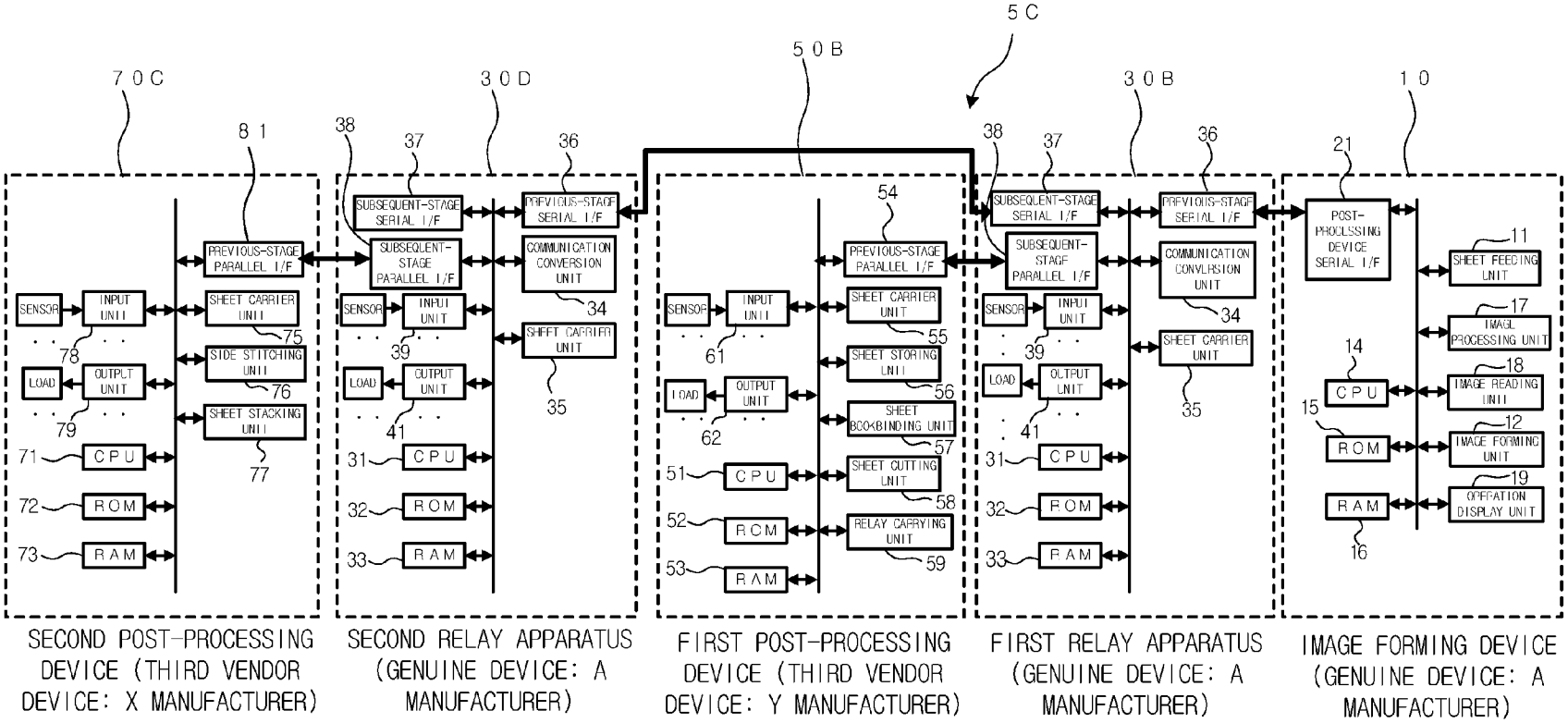
FIG. 14 is a block diagram showing an electrical outline configuration of each device of the image forming system shown in FIGS. 12 and 13.

FIG. 14 is a block diagram showing an outline configuration of each device of the image forming system 5C shown in FIGS. 12 and 13. Each electrical configuration of the image forming device 10, the first relay apparatus 30B, the second relay apparatus 30D, and the first post-processing device 50B is the same as that of the image forming device 10, the relay apparatus 30, and the first post-processing device 50 shown in FIG. 3. Therefore, the explanation thereof is omitted.

The second post-processing device 70C is different from the second post-processing device 70 shown in FIG. 3 in that the second post-processing device 70 has the previous-stage serial interface unit 74, and on the other hand, the second post-processing device 70C has a previous-stage parallel interface unit 81. With respect to the other electrical configurations, the second post-processing device 70C and the second post-processing device 70 are the same. The previous-stage parallel interface unit 81 performs the communication with the previous-stage device by using the parallel interface for the third vendor device.

Figure 15:
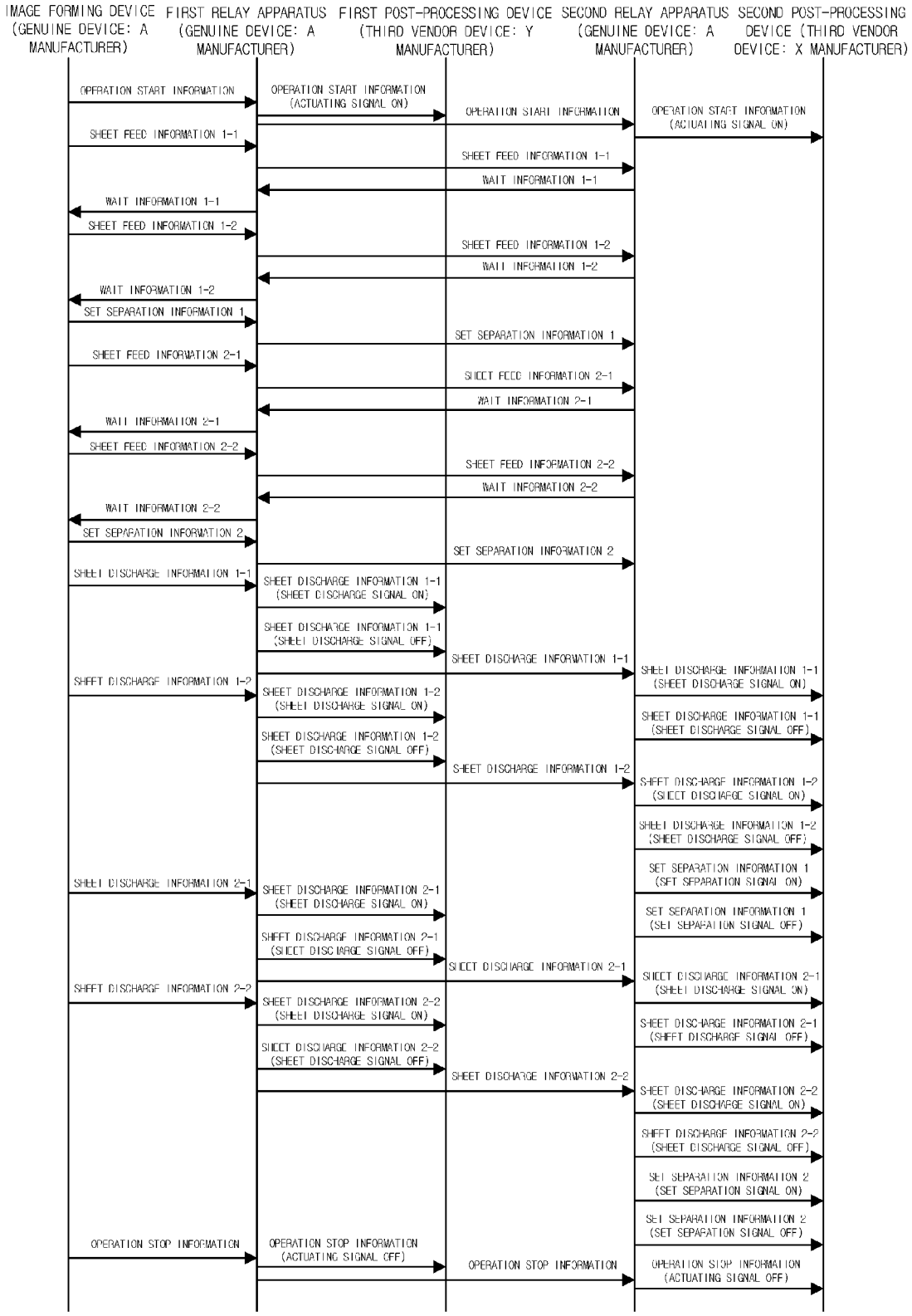
FIG. 15 shows a communication sequence in the case of creating two sets of brochures each of which has two sheets in the second post-processing device which is the third vendor device, in the image forming system shown in FIGS. 12 to 14 according to the second embodiment.

FIG. 15 shows a communication sequence in the case of creating two sets of brochures each of which has two sheets (two sets of brochures, one set of which has two sheets are created) in the second post-processing device 70C which is the third vendor device, of the image forming system 5C according to the second embodiment shown in FIGS. 12 to 14. In this operation, the sheet is carried by the bypass conveyance in the first post-processing device 50B.

The image forming device 10 transmits the operation start information to the first relay apparatus 30B through the serial interface. The first relay apparatus 30B receiving the operation start information notifies the first post-processing device 50B of the operation start information (actuating signal ON) through the parallel interface. In addition, the first relay apparatus 30B transfers the operation start information to the second relay apparatus 30D through the serial interface.

The operations of the second relay apparatus 30D are the same as those of the relay apparatus 30 in the communication sequence of FIG. 5 explained in the first embodiment, except that the upstream device is the first relay apparatus 30B. The second relay apparatus 30D analyzes the received operation start information and notifies the second post-processing device 70C of the operation start information (actuating signal ON) through the parallel interface.

Then, every when the sheet is fed, the image forming device 10 transmits the sheet feed information relating to the fed sheet to the first relay apparatus 30B. The first relay apparatus 30B receiving the sheet feed information transmits the received sheet feed information to the second relay apparatus 30D. Further, the first relay apparatus 30B calculates the wait time in the first post-processing device 50B, which corresponds to the sheet feed information received from the image forming device 10.

In place of the second post-processing device 70C, the second relay apparatus 30D creates the wait information indicating the wait time in the second post-processing device 70C, which corresponds to the received sheet feed information, and sends back the wait information to the first relay apparatus 30B. A method for calculating the wait time in the first relay apparatus 30B and in the second relay apparatus 30D is the same as that in the relay apparatus 30 shown in the first embodiment. Therefore, the explanation thereof is omitted.

The first relay apparatus 30B compares the wait time in the first post-processing device 50B, which is calculated by the first relay apparatus 30B and the wait time in the second post-processing device 70C, which is indicated by the wait information received from the second relay apparatus 30D, and transmits the wait information indicating the longer wait time to the image forming device 10.

By controlling the standby time at the standby position 13 based on the received wait information, the image forming device 10 discharges the sheet at the timing indicated by the wait information.

Further, the image forming device 10 synchronizes the set separation information with the sheet feed information relating to the final sheet of each set and transmits the set separation information to the first relay apparatus 30B. Then, the first relay apparatus 30B which receives the set separation information transfers the received set separation information to the second relay apparatus 30D. The second relay apparatus 30D temporarily stores the received set separation information in the RAM 33 and the like to buffer it. Then, the second relay apparatus 30D outputs the set separation signal in synchronization with the sheet discharge signal of the final sheet of each set.

The image forming device 10 outputs the sheet discharge information to the first relay apparatus 30B at the timing at which the sheet is actually discharged to the first relay apparatus 30B. Based on the detection state of the sheet discharge sensor of the first relay apparatus 30B, the first relay apparatus 30B outputs the sheet discharge information to the first post-processing device 50B through the parallel interface every when the sheet is discharged to the subsequent-stage first post-processing device 50B from the first relay apparatus 30B. Specifically, when the front-end of the sheet is discharged from the carrier outlet, the first relay apparatus 30B switches the sheet discharge signal to ON. On the other hand, when the back-end of the sheet is discharged from the carrier outlet, the first relay apparatus 30B switches the sheet discharge signal to OFF.

By this sheet discharge signal, the first post-processing device 50B which is the third vendor device, recognizes that the sheet is carried from the upstream device, and carries the sheet by the bypass conveyance in the first post-processing device 50B.

Further, the first relay apparatus 30B notifies the second relay apparatus 30D of the sheet discharge information by delaying the above notification for the time necessary for the bypass conveyance in the first post-processing device 503. Here, the first relay apparatus 30B previously stores the carrying time in the case of carrying the sheet by the bypass conveyance in the first post-processing device 50B. When the carrying time elapses since the front-end of the sheet is discharged from the first relay apparatus 30B, the first relay apparatus 30B transmits the sheet discharge information to the second relay apparatus 30D through the serial interface.

Based on the detection state of the sheet discharge sensor of the second relay apparatus 30D, the second relay apparatus 30D outputs the sheet discharge information to the second post-processing device 70C through the parallel interface every when the sheet is discharged to the subsequent-stage second post-processing device 70C from the second relay apparatus 30D. Specifically, when the front-end of the sheet is discharged from the carrier outlet, the second relay apparatus 30D switches the sheet discharge signal to ON. On the other hand, when the back-end of the sheet is discharged from the carrier outlet, the second relay apparatus 30D switches the sheet discharge signal to OFF.

Further, the second relay apparatus 30D outputs the set separation information to the second post-processing device 70C at the timing at which the final sheet of each set is discharged from the carrier outlet of the second relay apparatus 30D. To be more specific, when the sheet discharge sensor detects the back-end of the final sheet of the set, the second relay apparatus 30D switches the set separation signal to ON. On the other hand, when the sheet discharge sensor detects a front-end of a first sheet of the next set, the second relay apparatus 30D switches the set separation signal to OFF.

By the sheet discharge signal from the second relay apparatus 30D, the second post-processing device 70C which is the third vendor device, recognizes that the sheet is carried from the upstream device. Further, by the set separation signal from the second relay apparatus 30D, the second post-processing device 70C recognizes the separation of the set and performs the post-processing and carrier operations to the sheets one by one or set by set.

After the image forming device 10 completes the discharge of the second sheet of the second set, the image forming device 10 transmits the operation stop information to the first relay apparatus 30B. After the first relay apparatus 30B receiving the operation stop information completes the discharge of the second sheet of the second set to the first post-processing device 50B, the second relay apparatus 30B transmits the operation stop information to the first post-processing device 50B. At the same time, the first relay apparatus 30B transmits the operation stop information to the second relay apparatus 30D. After the second relay apparatus 30D receiving the operation stop information completes the discharge of the second sheet of the second set to the second post-processing device 70C, the second relay apparatus 30D transmits the operation stop information to the second post-processing device 70C.

The system configuration of the image forming system is not limited to those exemplified in the first and second embodiments. Also in a system in which a post-processing device which is the genuine device and a post-processing device which is the third vendor device are mixed, by the combination of the first and second embodiments, it is possible to perform the control, the sheet carrier, and the post-processing operations like the above embodiments, regardless of the configuration, the connection order and the like.

Third Embodiment

An image forming system 5E according to the third embodiment has a system configuration in which a first post-processing device which is a third vendor device has no interface with a subsequent-stage device and in which a second post-processing device which is a third vendor device is connected. In the present embodiment, the second relay apparatus is not required, that is, the first post-processing device which is the third vendor device and the second post-processing device which is the third vendor device are manufactured by the same manufacturer, and the ground heights of the carrier inlet and the carrier outlet are the same.

Figure 16:
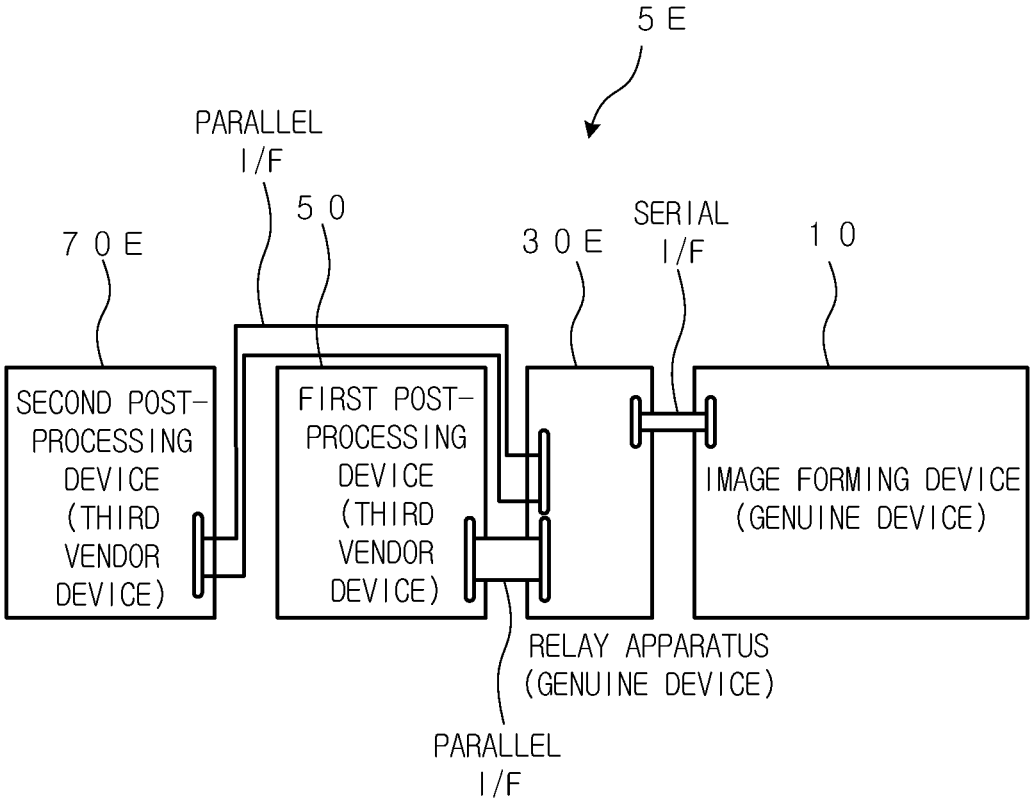
FIG. 16 shows the connection state of the communication lines in the image forming system according to the third embodiment.

FIG. 16 shows a connection state of the communication lines in the image forming system 5E. The image forming device 10 and a relay apparatus 30E are genuine devices, and are connected through the serial interface which is compliant with the specifications of the genuine device manufacturer. The relay apparatus 30E and the first post-processing device 50 are connected through the parallel interface (referred to as parallel communication 1) for the third vendor device. Further, the relay apparatus 30E and the second post-processing device 70E are connected through the parallel interface (referred to as parallel communication 2) for the third vendor device.

Figure 17:
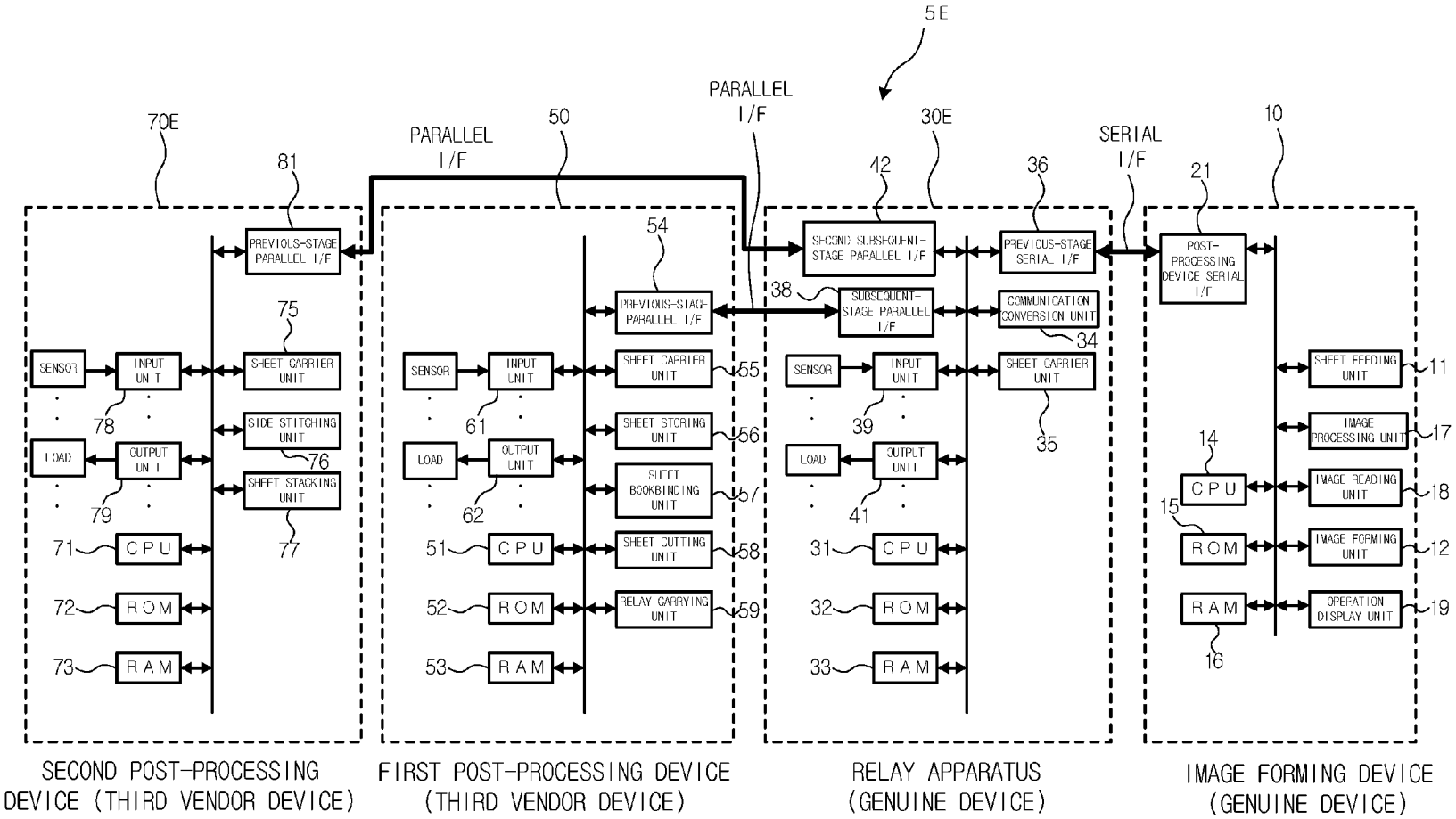
FIG. 17 is a block diagram showing an electrical outline configuration of each device of the image forming system according to the third embodiment.

FIG. 17 is a block diagram showing an outline configuration of each device of the image forming system 5E shown in FIG. 16. The image forming device 10 and the first post-processing device 50 are the same as those of the first embodiment (FIG. 3). The relay apparatus 30E has the substantially same configuration as the relay apparatus 30 of FIG. 3, and is different from the relay apparatus 30 in that the replay apparatus 30E comprises a second subsequent-stage parallel interface unit 42 in place of the subsequent-stage serial interface unit 37. The second post-processing device 70E has the substantially same configuration as the second post-processing device 70 of FIG. 3, and is different from the second post-processing device 70 in that the second post-processing device 70E comprises a previous-stage parallel interface unit 81 in place of the previous-stage serial interface unit 74.

Figure 18:
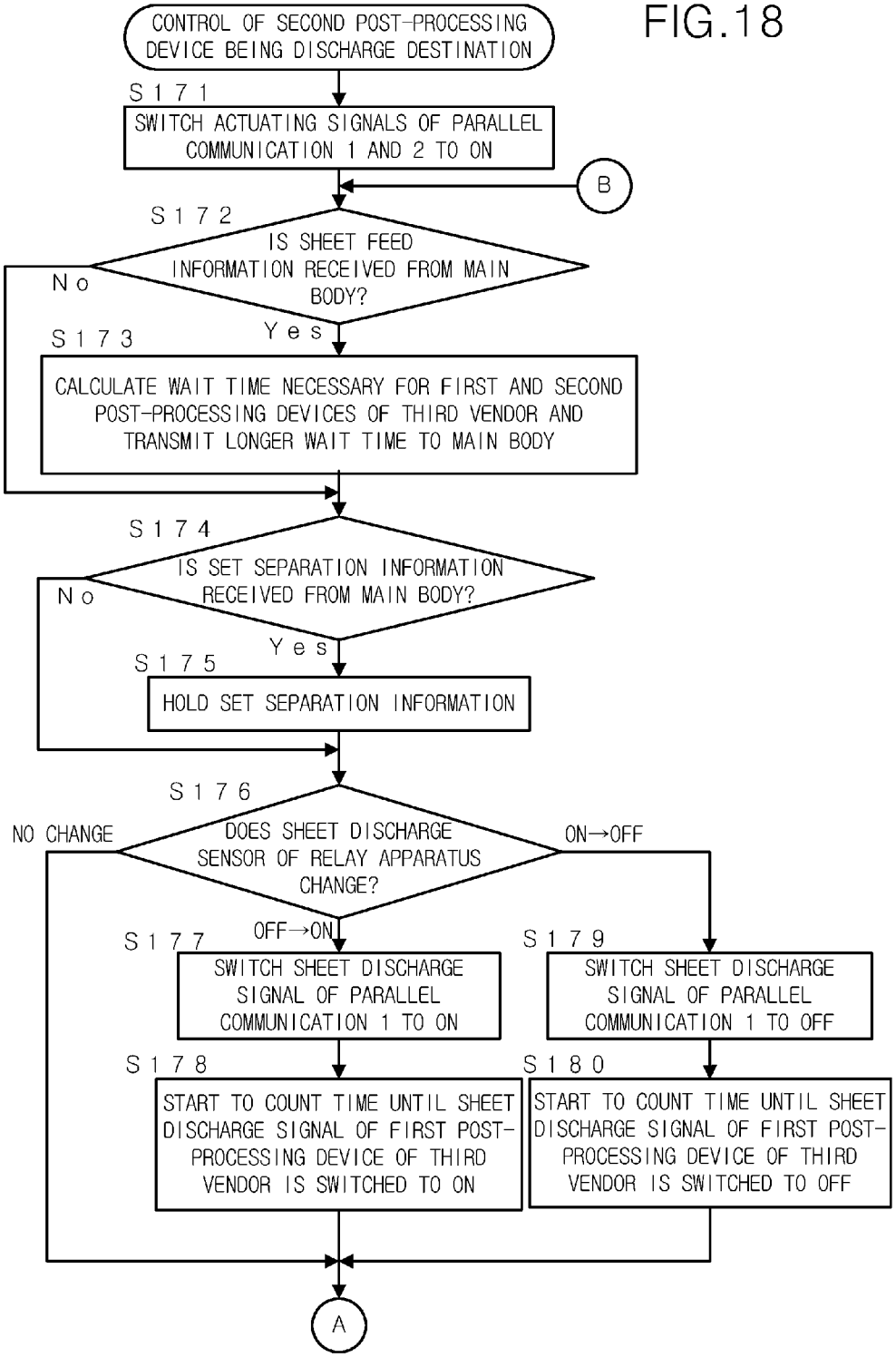
FIG. 18 is a flowchart showing details of a process of "control of second post-processing device being discharge destination
Figure 19:
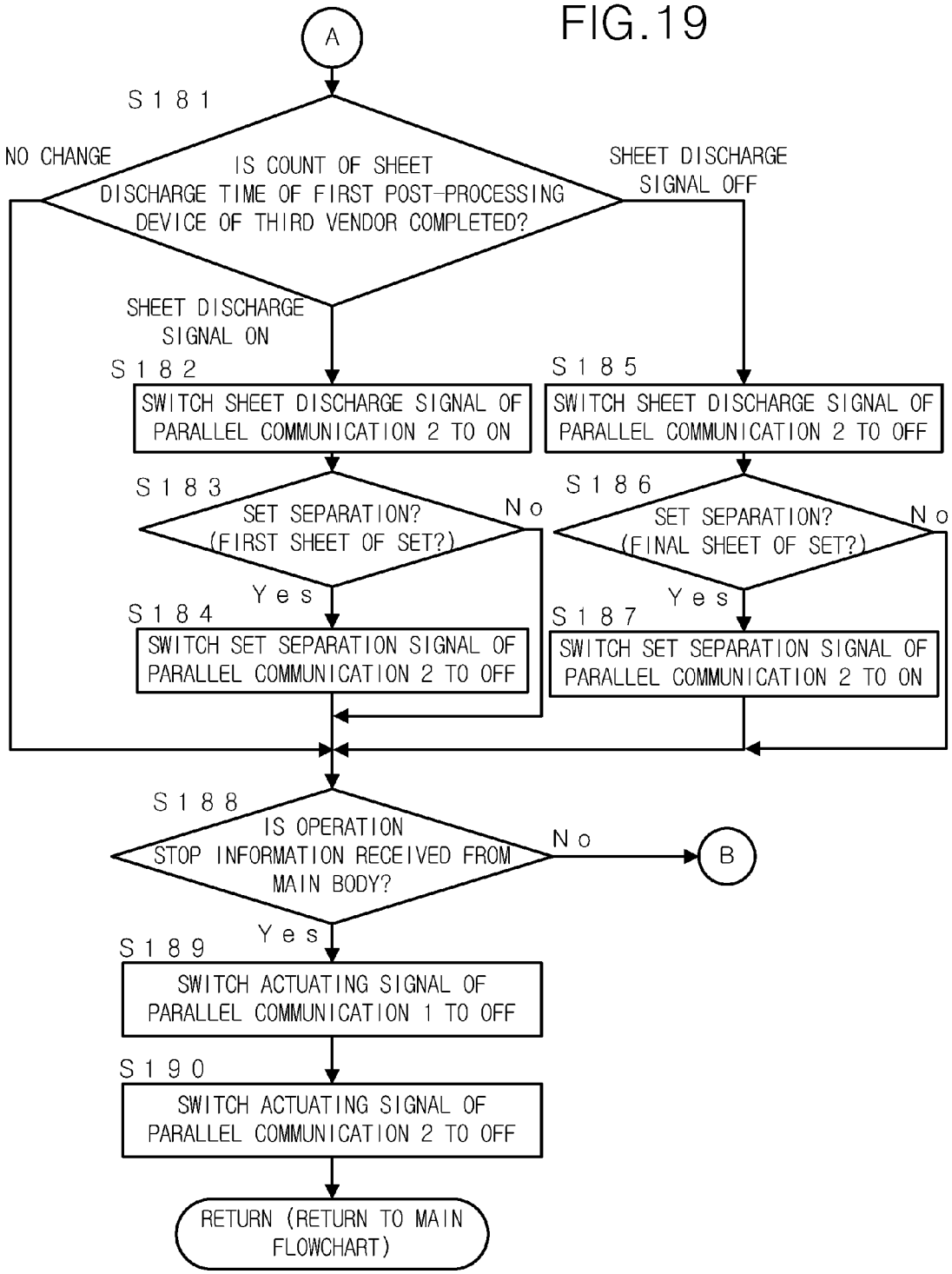
FIG. 19 is a flowchart showing the subsequent process of FIG. 18.
Figure 20:
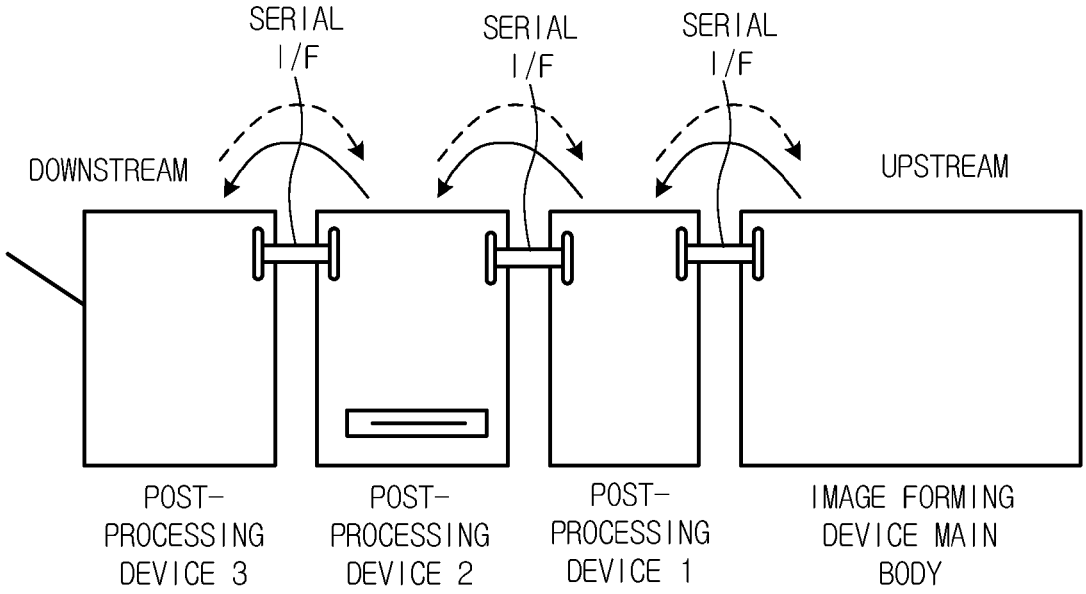
FIG.20 PRIOR ART
FIG. 20 shows a connection example of a conventional image forming system in which an image forming device and a plurality of post-processing devices are connected in series through serial interfaces of the same communication system (protocol)

The main process performed by the relay apparatus 30E according to the third embodiment is the same as that of FIG. 8. In the third embodiment, the second post-processing device 70E is used as the second post-processing device. Further, the process contents of step S104 are replaced with those of FIGS. 18 and 19.

The relay apparatus 30E switches the actuating signal of the parallel communication 1 to ON by using the subsequent-stage parallel interface unit 38 which communicates with the first post-processing device 50. At the same time, the relay apparatus 30E switches the actuating signal of the parallel communication 2 to ON by using the second subsequent-stage parallel interface unit 42 which communicates with the second post-processing device 70E (Step S171).

Next, the relay apparatus 30E waits for the reception of the sheet feed information from the image forming device 10 (main body). In case that the replay apparatus 30E does not receive the sheet feed information (Step S172; No), the process proceeds to step S174. When the relay apparatus 30E receives the sheet feed information (Step S172; Yes), the relay apparatus 30E calculates the wait time necessary for the first post-processing device 50 which is the third vendor device, in accordance with the sheet information included in the sheet feed information. In addition, the relay apparatus 30E calculates the wait time necessary for the second post-processing device 70E which is the third vendor device, in accordance with the sheet information included in the sheet feed information. A method for calculating the wait time is the same as that of the first embodiment. Further, the relay apparatus 30E compares the wait time in the first post-processing device 50 which is the third vendor device and the wait time in the second post-processing device 70E which is the third vendor device. Further, the relay apparatus 30E transmits the wait information indicating the longer wait time to the image forming device 10 (Step S173). Then, the process proceeds to step S174.

At step S174, the relay apparatus 30E determines whether to receive the set separation information from the image forming device 10. In case that the relay apparatus 30E does not receive the set separation information (Step S174; No), the process proceeds to step S176. When the relay apparatus 30E receives the set separation information (Step S174; Yes), the relay apparatus 30E holds the set separation information (Step S175). The process proceeds to step S176. The relay apparatus 30E does not transmit the set separation information to the first post-processing device 50.

At step S176, the relay apparatus 30E determines whether a sheet discharge sensor of the relay apparatus 30E changes. When the sheet discharge sensor does not change (Step S176: No change), the process proceeds to step S181. When the sheet discharge sensor changes from OFF to ON (Step S176; OFF-SON), the relay apparatus 30E switches the sheet discharge signal of the parallel communication 1 to ON (Step S177). Further, the relay apparatus 30E starts to count the time until the front-end of the sheet is discharged from the first post-processing device 50 which is the third vendor device (Step S178), and the process proceeds to step S181.

When the sheet discharge sensor changes from ON to OFF (Step S176; ON→OFF), the relay apparatus 30E switches the sheet discharge signal of the parallel communication 1 to OFF (Step S179). Further, the relay apparatus 30E starts to count the time until the back-end of the sheet is discharged from the first post-processing device 50 which is the third vendor device (Step S180), and the process proceeds to step S181.

At step S181, the relay apparatus 30E determines whether the count started at steps S178 and S180 is completed (the count reaches a specified count value). In case that the count is not completed (Step S181; No change), the process proceeds to step S188.

When the count of the time until the front-end of the sheet is discharged from the first post-processing device 50 which is the third vendor device is completed (Step S181; sheet discharge signal ON), the relay apparatus 30E switches the sheet discharge signal of the parallel communication 2 to ON (Step S182). The relay apparatus 30E determines whether the discharged sheet is a first sheet of the set (Step S183). In case that the sheet is not a first sheet of the set (Step S183; No), the process proceeds to step S188. In case that the sheet is a first sheet of the set (Step S183; Yes), the relay apparatus 30E switches the set separation signal of the parallel communication 2 to OFF (Step S184), and the process proceeds to step S188.

When the count of the time until the back-end of the sheet is discharged from the first post-processing device 50 which is the third vendor device is completed (Step S181; sheet discharge signal OFF), the relay apparatus 30E switches the sheet discharge signal of the parallel communication 2 to OFF (Step S185). The relay apparatus 30E determines whether the discharged sheet is a final sheet of the set (Step S186). In case that the sheet is not a final sheet of the set (Step S186; No), the process proceeds to step S188. In case that the sheet is a final sheet of the set (Step S186; Yes), the relay apparatus 30E switches the set separation signal of the parallel communication 2 to ON (Step S187), and the process proceeds to step S188.

At step S188, the relay apparatus 30E determines whether to receive the operation stop information from the image forming device 10. In case that the relay apparatus 30E does not receive the operation stop information (Step S188; No), the process returns to step S172 and is continued. When the relay apparatus 30E receives the operation stop information (Step S188; Yes), the relay apparatus 30E switches the actuating signal of the parallel communication 1 to OFF (Step S189) and the actuating signal of the parallel communication 2 to OFF (Step S190), and the process returns to the process shown in FIG. 8 (return).

As described above, in the relay apparatus and the image forming system including the relay apparatus according to at least one of the embodiments, by communicatively connecting a plurality of post-processing devices having different communication system to the image forming device 10, the sheet carrier and the post-processing operations can be performed. In particular, in the image forming device 10 and the post-processing device which is the third vendor device, it is not required to consider the connection between the image forming device 10 and the post-processing device having the different communication systems from each other. Therefore, the burden, such as the development, the design, the manufacture of the image forming system, is reduced.

Further, the relay apparatus switches the operation for the subsequent-stage post-processing device or the operation for the subsequent-stage relay apparatus according to the contents of the post-processing or the discharge destination (in at least one of the embodiments, the relay apparatus switches between the control of the first post-processing device to be the discharge destination and the control of the second post-processing device to be the discharge destination). Therefore, the relay apparatus can automatically control various types of post-processings without changing the configuration (connection order or the like) of the image forming system.

Further, in the second embodiment, the difference in the ground heights between the carrier outlet and the carrier inlet of the third vendor device and the carrier outlet and the carrier inlet of the genuine device is absorbed by the relay apparatus. Therefore, by connecting a plurality of different devices through the above relay apparatus, the intended image forming system can be configured so as to solve not only the problem relating to the communication system but also the problem relating to the ground heights of the carrier outlet and the carrier inlet for sheets.

As described above, the embodiments are explained by using the drawings. However, in the present invention, the concrete configuration is not limited to the above embodiments. In the present invention, various modifications of the above embodiments or the addition of various functions or the like to the embodiments can be carried out without departing from the gist of the invention.

In at least one of the embodiments, the case in which the sheet interval and the wait information as the sheet interval information are indicated by using the time, is explained. Further, the sheet interval and the wait information may be indicated by using the distance between sheets. For example, the distance and the carrier speed are converted into the time.

In at least one of the embodiments, in the relay apparatus the carrier path is included. In case that the ground heights of the carrier outlet and the carrier inlet are the same in each device like the first and third embodiments, the relay apparatus does not have the carrier path of sheets and may be simply configured as a device for performing the relay of the communication. In this case, in order to form the carrier path, one or a plurality of post-processing devices may be connected in series to a subsequent stage of the image forming device 10. In case that only the relay of the communication is performed without having the carrier path as described above, the relay apparatus may be integrated with the image forming device 10.

In at least one of the embodiments, the example in which when the post-processing is performed in the second post-processing device, the sheet is carried by the bypass conveyance in the first post-processing device, is explained. However, the post-processings may be performed in both of the first and second post-processing devices.

In at least one of the embodiments, the communication between the genuine devices is performed through the serial interface and the communication between the genuine device and the third vendor device is performed through the parallel interface. However, the present invention is not limited to the above communications. The present invention can be applied to the case in which different communication systems are used.

One of the objects of the above embodiments is to provide a relay apparatus which can transmit the set separation information output from the image forming device to a post-processing device having a different communication system at the timing corresponding to the post-processing device, and an image forming system comprising the above relay apparatus.

In at least one of the embodiments, the post-processing device which is compliant with the second communication system which is different from the first communication system can be connected to the image forming device which performs the communication through the first communication system, via the relay apparatus. That is, when the set separation information is received from the image forming device in synchronization with the sheet information, the relay apparatus stores the set separation information in the storage unit. Then, the relay apparatus transmits the set separation information to the downstream post-processing device at the timing at which the final sheet of the set is discharged to the above post-processing device.

In at least one of the embodiments, the relay apparatus comprises the sheet carrier unit which carries and discharges the sheet received from an upstream device to a downstream device. In case that the height at which the carrier outlet of the upstream device is disposed from the installation surface of the relay apparatus is different from the height at which the carrier inlet of the downstream device is disposed from the installation surface of the relay apparatus, the relay apparatus is connected between the above devices as the carrier path for absorbing the difference in the height.

In at least one of the embodiments, after the final sheet of the set is completely discharged to the post-processing device, the relay apparatus outputs the set separation information to the post-processing device.

In at least one of the embodiments, when the sheet is fed, the image forming device outputs the sheet information to the downstream post-processing device. The image forming device discharges the sheet to the downstream device at the timing indicated by the sheet interval information received as a response of the sheet information. That is, the fed sheet is temporarily stopped at the standby position in the image forming device. Then, the standby state is released and the fed sheet is discharged at the timing indicated by the sheet interval information.

In at least one of the embodiments, in the state in which the post-processing device and the second post-processing device are connected to the image forming device, when the post-processing for the printed sheet is performed only in one device, the relay apparatus notifies only the device which performs the post-processing, of the set separation information.

According to the relay apparatus and the image forming system, the set separation information output from the image forming device can be transmitted to the post-processing device having a different communication system at the timing corresponding to the post-processing device. In the system, the image forming device and the post-processing device having a different communication system can be connected.

The present U.S. patent application claims the priority of Japanese Patent Application No. 2012-175421, filed on Aug. 7, 2012, according to the Paris Convention, and the entirety of which is incorporated herein by reference for correction of incorrect translation.

What is claimed is:

1. A relay apparatus comprising:

a receiving unit to receive set separation information indicating a final sheet of each set of documents to be printed, from an image forming device which is compliant with a first communication system, the image forming device notifying at least one downstream post-processing device of sheet information relating to a sheet on which an image is formed, before the sheet is discharged, and the image forming device notifying the downstream post-processing device of the set separation information in synchronization with the sheet information relating to the final sheet of each set of documents in a case in which a plurality of sets of documents are printed, wherein the at least one downstream post-processing device comprises a first post-processing device which is connected to a downstream side of the image forming device and is compliant with a second communication system which is different from the first communication system;

a storage unit to store the set separation information received by the receiving unit; and a notification unit to notify the first post-processing device of the set separation information stored in the storage unit, in synchronization with a timing at which the final sheet of the each set indicated by the set separation information is discharged to the first post-processing device.

2. The relay apparatus of claim 1, wherein a communication with the image forming device is performed by a serial communication, and a communication with the first post-processing device is performed by a parallel communication.

3. The relay apparatus of claim 1, further comprising a sheet carrier unit to receive the sheet from a carrier outlet of an upstream device of the relay apparatus, and to carry and discharge the sheet to a carrier inlet of a downstream device of the relay apparatus, the carrier inlet being disposed at a height from an installation surface of the relay apparatus, which is different from a height at which the carrier outlet of the upstream device is disposed from the installation surface.

4. The relay apparatus of claim 1, wherein after a back-end of the final sheet of the each set is discharged to the first post-processing device, the notification unit notifies the first post-processing device of the set separation information.

5. The relay apparatus of claim 1, wherein the relay apparatus sends, to the image forming device, sheet interval information indicating a sheet interval necessary for the first post-processing device as a response to the sheet information transmitted every time when the sheet is fed, and the image forming device discharges the sheet at a timing based on the sheet interval information.

6. The relay apparatus of claim 1, wherein in a case in which a second post-processing device which is compliant with the first communication system is further connected to the downstream side of the image forming device, (i) when only the second post-processing device performs a post-processing for the sheet, the notification unit does not notify the first post-processing device of the set separation information and the notification unit notifies the second post-processing device of the set separation information in synchronization with the sheet information relating to the final sheet of the each set, and (ii) when only the first post-processing device performs a post-processing for the sheet, the notification unit does not notify the second post-processing device of the set separation information and the notification unit notifies the first post-processing device of the set separation information in synchronization with the timing at which the final sheet of the each set is discharged to the post-processing device.

7. An image forming system comprising:

an image forming device to notify a downstream post-processing device of sheet information relating to a sheet on which an image is formed, before the sheet is discharged, and to notify the downstream post-processing device of set separation information indicating a final sheet of each set of documents to be printed in synchronization with the sheet information relating to the final sheet of each set in a case in which a plurality of sets of documents are printed, the image forming device being compliant with a first communication system;

the downstream post-processing device, which is connected to a downstream side of the image forming device and which is compliant with a second communication system which is different from the first communication system; and the relay apparatus of claim 1, which is connected to the image forming device through the first communication system and which is connected to the downstream post-processing device through the second communication system.

8. An image forming system comprising:

an image forming device to notify at least one downstream post-processing device of sheet information relating to a sheet on which an image is formed, before the sheet is discharged, and to notify the downstream post-processing device of set separation information indicating a final sheet of each set of documents to be printed in synchronization with the sheet information relating to the final sheet of each set in case that a plurality of sets of documents are printed, the image forming device being compliant with a first communication system, wherein the at least one downstream post-processing device comprises a first post-processing device and a second post-processing device;

the first post-processing device, which is connected to a downstream side of the image forming device and which is compliant with a second communication system which is different from the first communication system;

the second post-processing device, which is connected to the downstream side of the image forming device and which is compliant with the first communication system; and the relay apparatus of claim 6, which is connected to the image forming device and the second post-processing device through the first communication system, and is connected to the first post-processing device through the second communication system.

* * * * *